US010823019B2

(12) United States Patent
Dunn et al.

(10) Patent No.: US 10,823,019 B2
(45) Date of Patent: Nov. 3, 2020

(54) DUCTED POSITIVE CRANKCASE VENTILATION PLENUM

(71) Applicant: Ford Global Technologies, LLC, Dearborn, MI (US)

(72) Inventors: Matthew Dunn, Dearborn, MI (US); Paul Shoemaker, Dearborn, MI (US); Darren Sipila, Royal Oak, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 280 days.

(21) Appl. No.: 16/051,279

(22) Filed: Jul. 31, 2018

(65) Prior Publication Data

US 2020/0040782 A1 Feb. 6, 2020

(51) Int. Cl.

*F01M 13/04* (2006.01)
*F01M 13/02* (2006.01)
*F02M 35/10* (2006.01)

(52) U.S. Cl.

CPC ..... *F01M 13/0405* (2013.01); *F01M 13/022* (2013.01); *F01M 13/0416* (2013.01); *F02M 35/10222* (2013.01); *F01M 2013/0461* (2013.01)

(58) Field of Classification Search

CPC ..... F01M 13/0405; F01M 13/022; F01M 13/0416; F01M 2013/0461; F01M 13/04; F01M 13/0011; F01M 2013/0038; F01M 2013/0044; F02M 35/10222

See application file for complete search history.

(56) References Cited

U.S. PATENT DOCUMENTS 1,654,147 A * 12/1927 Shannon ..... F01M 13/04 55/355
4,502,424 A * 3/1985 Katoh ..... F01M 5/00 123/196 R
6,234,154 B1 * 5/2001 Spix ..... F01M 13/022 123/572
6,431,157 B1 * 8/2002 Marcil ..... F01M 13/00 123/568.11
7,181,926 B2 2/2007 Bhatia et al.
9,556,767 B2 1/2017 Newman et al.
2001/0032635 A1 * 10/2001 Kimura ..... F01M 13/022 123/572
2004/0159313 A1 * 8/2004 Obayashi ..... F01M 13/04 123/572
2007/0215128 A1 * 9/2007 Yonebayashi ..... F01M 13/0416 123/572

(Continued)

FOREIGN PATENT DOCUMENTS

CN 101457680 A 6/2009
CN 102705040 A 10/2012

(Continued)

*Primary Examiner* — Hung Q Nguyen
(74) *Attorney, Agent, or Firm* — Geoffrey Brumbaugh; McCoy Russell LLP

(57) ABSTRACT

Methods and systems are provided for a ducted plenum of a positive crankcase ventilation system for an engine. In one example, the ducted plenum may include a plurality of ducts coupled to a central chamber and an oil separator and valve arranged downstream of the central chamber. The ducted plenum may vent gases from an engine crankcase and deliver the vented gases to the engine intake system.

20 Claims, 8 Drawing Sheets

(56) References Cited

U.S. PATENT DOCUMENTS

| | | | | |
|---|---|---|---|---|
| 2010/0101269 | A1 | 4/2010 | Theodore, Jr. et al. | |
| 2011/0314779 | A1* | 12/2011 | Sakaguchi | F01M 13/0416 55/464 |
| 2012/0304971 | A1* | 12/2012 | Rice | F01M 13/04 123/573 |
| 2015/0114368 | A1* | 4/2015 | Kurita | F16N 13/04 123/573 |
| 2015/0226097 | A1* | 8/2015 | Hasegawa | F01M 13/00 123/574 |
| 2016/0194987 | A1 | 7/2016 | Lawrence et al. | |
| 2016/0376950 | A1* | 12/2016 | Kira | F01M 13/04 123/573 |

FOREIGN PATENT DOCUMENTS

| | | | | |
|---|---|---|---|---|
| CN | 202770087 | U | 3/2013 | |
| CN | 206000638 | U | 3/2017 | |
| DE | 102012012181 | A1 * | 12/2013 | F01M 13/022 |
| EP | 2594757 | A1 * | 5/2013 | F01M 13/0416 |
| EP | 2653678 | A1 * | 10/2013 | F02M 25/06 |
| JP | 2009209814 | A | 9/2009 | |
| WO | WO-2013129556 | A1 * | 9/2013 | F01M 13/04 |
| WO | WO-2016039142 | A1 * | 3/2016 | F01M 13/00 |

* cited by examiner

DUCTED POSITIVE CRANKCASE VENTILATION PLENUM

FIELD

The present description relates generally to a system for providing ventilation to an engine crankcase.

BACKGROUND/SUMMARY

During a power stroke of piston of an engine cylinder, a portion of the gases combusted within the cylinder may leak past a ring forming a seal around the piston base in a process known as blow-by. The escaped gases may accumulate in the crankcase, resulting in a buildup of pressure that may lead to degradation of oil stored in the crankcase to lubricate piston movement. To preserve oil integrity and alleviate pressure in the crankcase, the engine may include a crankcase ventilation system to vent gases out of the crankcase and into an engine intake manifold.

In some examples, positive crankcase ventilation (PCV) systems may use steady state pressure differences to inject fresh air into the crankcase or pull fresh air mixed with blow-by gases out of the crankcase. The PCV systems may include a valve that is actuated between open and closed positions based on a pressure gradient between the intake manifold and the crankcase. A lower pressure at the intake manifold relative to the crankcase may drive recirculation of combustion gases in the crankcase to return the gases to the intake manifold.

The recirculated gases may mix with oil vapors in the crankcase and carry entrained oil to the intake manifold. To prevent ingestion of oil at the engine cylinders, a separation device, such as a filter, may be arranged upstream of the PCV valve that removes oil from the gases prior to delivery to the intake manifold. One example approach for addressing the issue of oil separation during alleviation of pressure from the crankcase is shown by Newman et al. in U.S. Pat. No. 9,556,767. Therein, an engine with PCV passages integrated into a cam cover of the engine is described. An oil separator is arranged upstream of a PCV valve between a gas-passing passage and the valve. The gas-passing passage is a manifold chamber which collects vented gases from the crankcase and channels the gas through the oil separator and PCV valve to return to an intake manifold of the engine.

However, the inventors herein have recognized potential issues with such systems. As one example, pressure signals within each bay of an engine may vary depending on an architecture of the engine, an order of cylinder firing, as well as engine operating conditions. For example, in an I4 engine, a first and fourth piston may be in phase with each other and out of phase with a second and third piston. The resulting flow of gases from the cylinder bays to an oil separator downstream of the cylinder bays may be highly turbulent due to the varying pressure signatures between bays. As a result of the turbulent flowfield, an efficiency of the oil separator may be reduced.

In one example, the issues described above may be addressed by a method for a ducted plenum for a positive crankcase ventilation (PCV) system, comprising a central chamber, an upper chamber including an oil separator and a PCV valve, and coupled to and extending upward from the central chamber, in a vertical direction, a first duct coupled to and extending outward from the central chamber in a direction perpendicular to the vertical direction, and a second duct coupled to and extending downward and away from the central chamber. In this way, the ducts of the ducted plenum may dampen the flowfield upstream of the oil separator, allowing for more efficient removal of oil from the vented gases.

As one example, the ducted plenum may fluidly couple cylinder bays of the engine to a central chamber of the ducted plenum. Blow-by gases flowing into each of the cylinder bays may be vented into the ducted plenum through the ducts, collecting in a central chamber of the ducted plenum. The ducts may be configured with individualized geometries to adjust flow velocities through each of the ducts so that a pressure signature of the central chamber is maintained uniform, allowing the influx of gases to settle before passing through the oil separator and PCV valve and being delivered to the engine intake. As a result, extraction of oil from the vented gases is achieved while an integrity of the oil in the crankcase is prolonged.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 3-7 and 9 are shown approximately to scale

DETAILED DESCRIPTION

Figure 2:
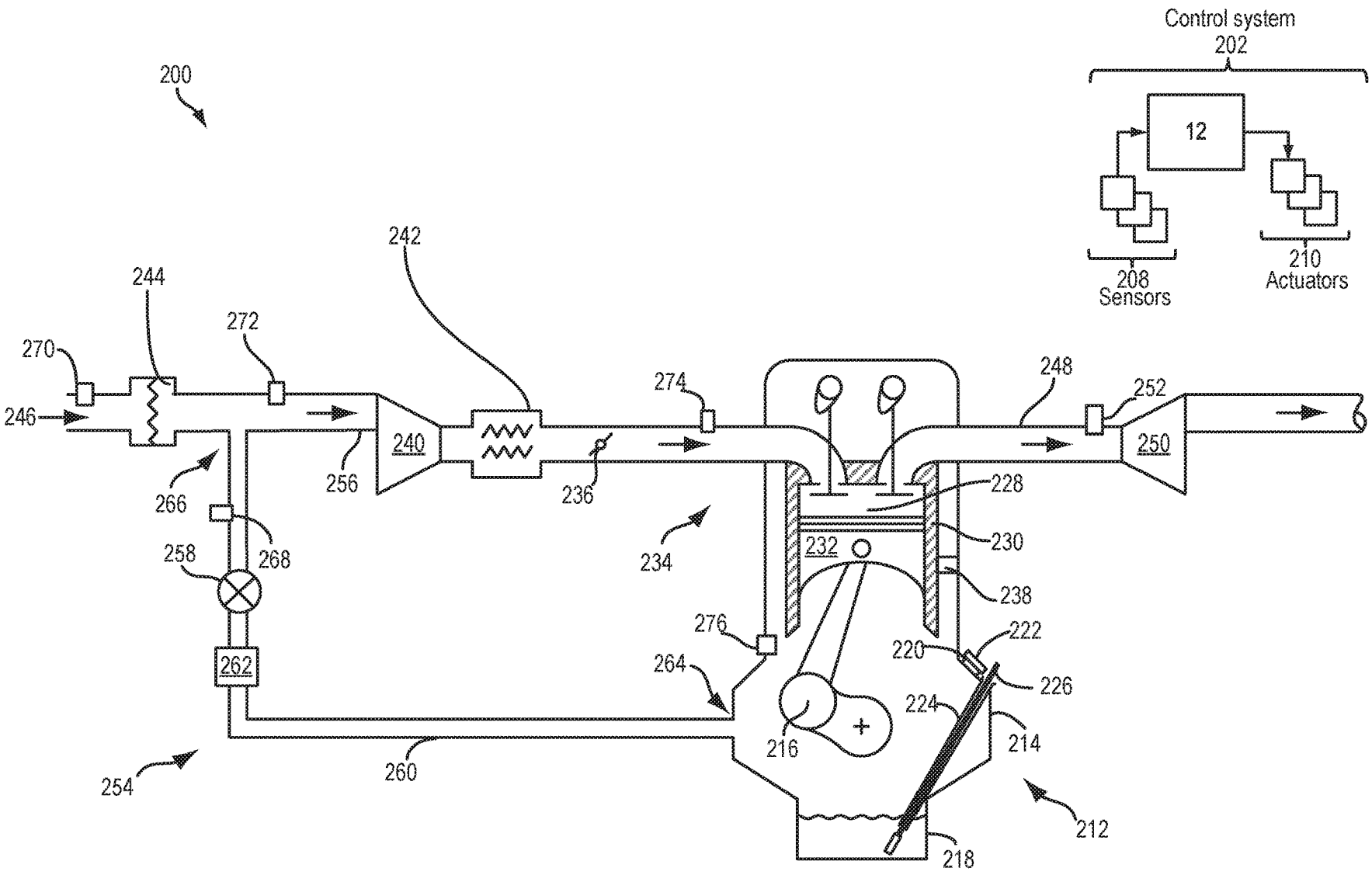
FIG. 2 shows an example of an engine with a PCV system coupled to a cylinder of the engine.
Figure 3:
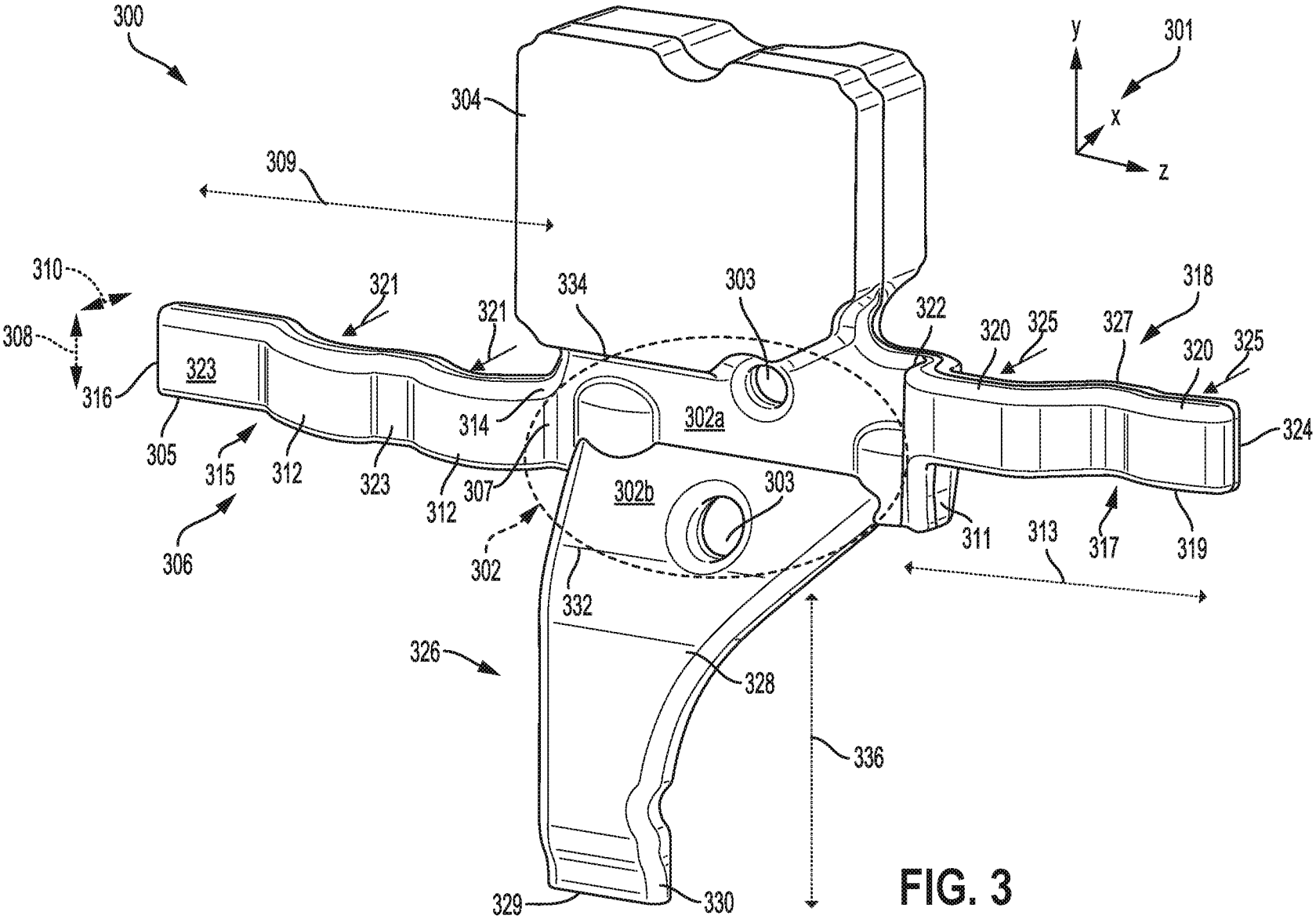
FIG. 3 shows an embodiment of a ducted plenum for a PCV system.
Figure 4:
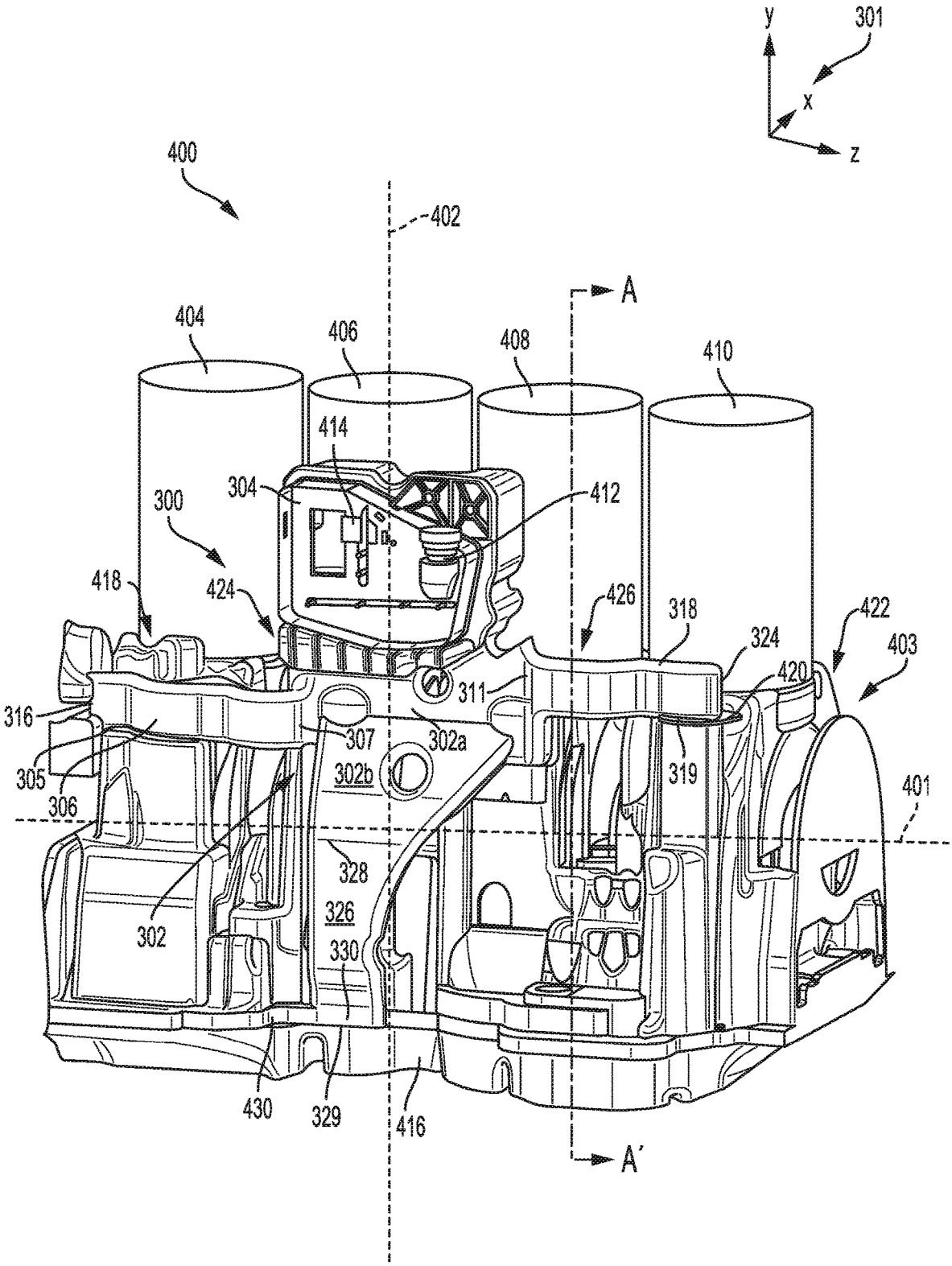
FIG. 4 shows the ducted plenum coupled to cylinder bays and a crankcase of an engine.
Figure 5:
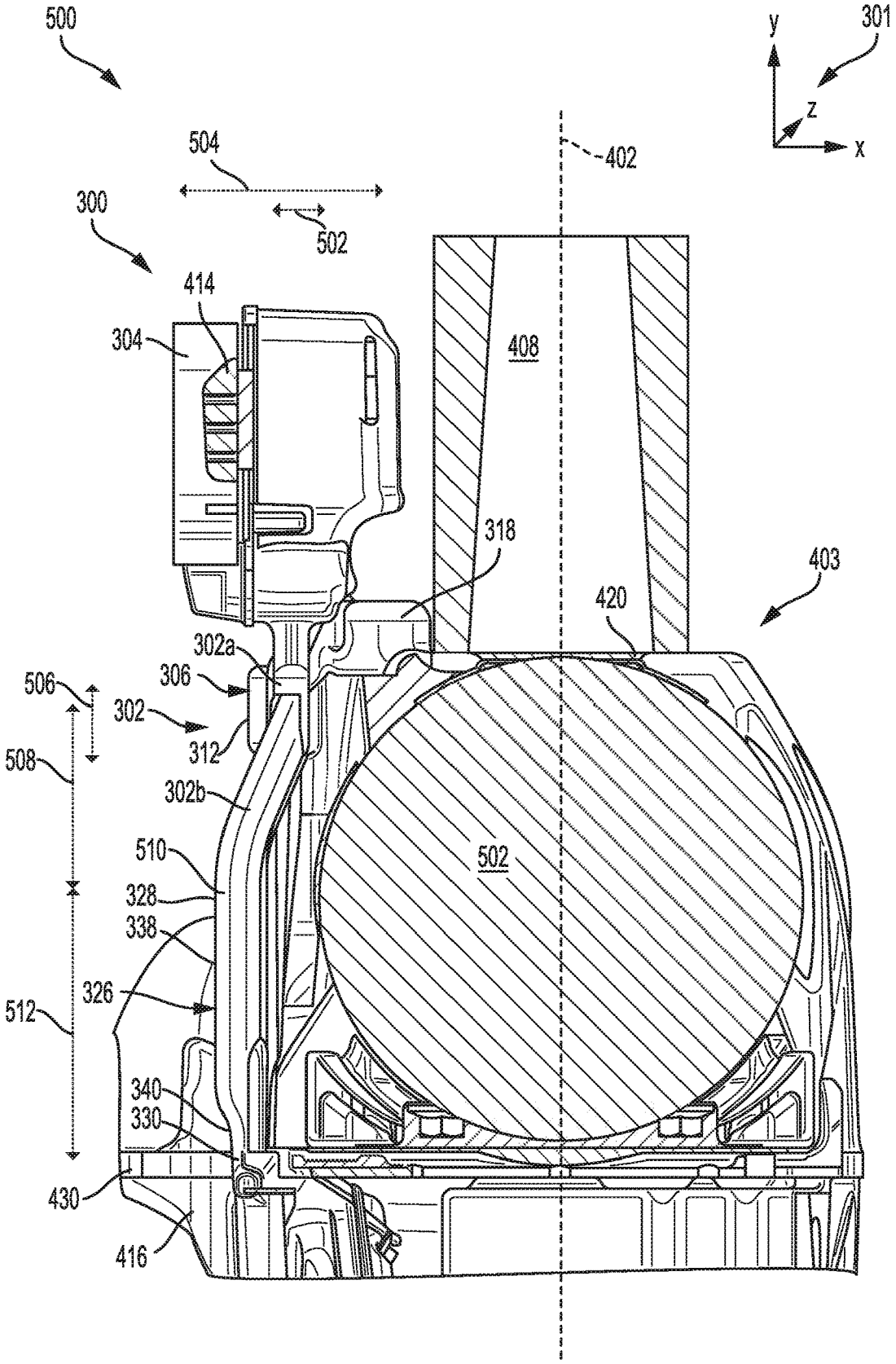
FIG. 5 shows a side view of an engine adapted with the ducted plenum for the PCV system.
Figure 6:
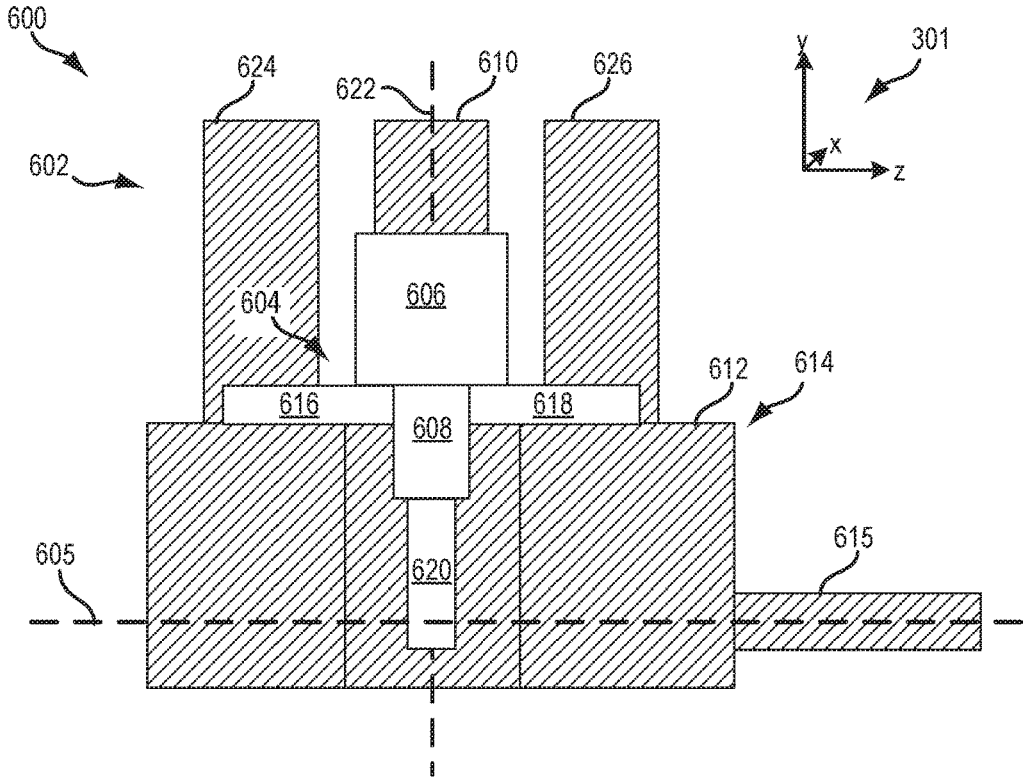
FIG. 6 shows a schematic diagram of a 3-cylinder inline engine adapted with a first embodiment of a ducted plenum for a PCV system of the 3-cylinder inline engine.
Figure 7:
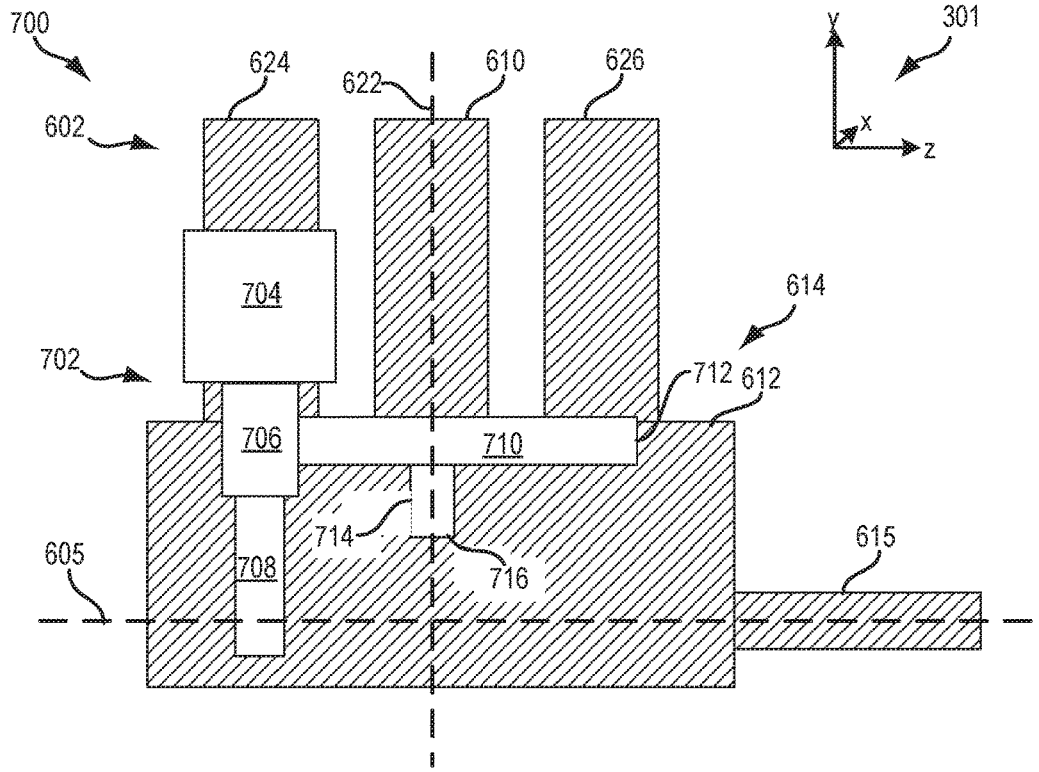
FIG. 7 shows a schematic diagram of a 3-cylinder inline engine adapted with a second embodiment of a ducted plenum for a PCV system of the 3-cylinder inline engine.

The following description relates to systems and methods for a PCV system. In an engine system, a crankcase may accumulate pressure due to blow-by of combustion gases. A PCV system may be installed in the engine, coupled to an exhaust system, to recirculate blow-by gases to an engine intake system. An example of an engine system adapted with the PCV system is shown in a schematic diagram in FIG. 1. An example of an engine, depicting a single combustion chamber of the engine and an arrangement of the PCV system relative to the combustion chamber is illustrated in FIG. 2. The PCV system may include a ducted plenum with ducts that couple to cylinder bays of the engine. Blow-by gases may collect in the ducted plenum from the cylinder bays before passing through an oil separator arranged upstream of a PCV valve, the PCV valve controlling flow of gases from the crankcase to the engine intake system. An example of a ducted plenum for an inline, four cylinder engine is illustrated in FIG. 3. Ducts of the plenum manifold may be fluidly coupled to the cylinder bays, channeling gases from the crankcase to the plenum manifold. An example of how the plenum manifold and ducts are positioned relative to cylinders of an inline four-cylinder engine through the crankcase is depicted in FIG. 4 and shown from a side view in FIG. 5. Example embodiments of the ducted plenum for the PCV system, adapted to an inline three cylinder engine are illustrated in schematic diagrams in FIGS. 6 and 7, showing variations in how the ducted plenum may be coupled to the engine. An example of a routine for the ducted plenum is provided in FIG. 8, describing a series of events occurring during positive ventilation of blow-by gases from the crankcase to the engine intake. A cross-section of the inline four-cylinder engine is depicted in FIG. 9, tracing a flow path of blow-by gases generated in each cylinder, flowing from the cylinder, into the crankcase, and into an opening of a duct of the ducted plenum, the opening of the duct coupled to the crankcase.

FIGS. 3-7 and 9 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

Figure 1:
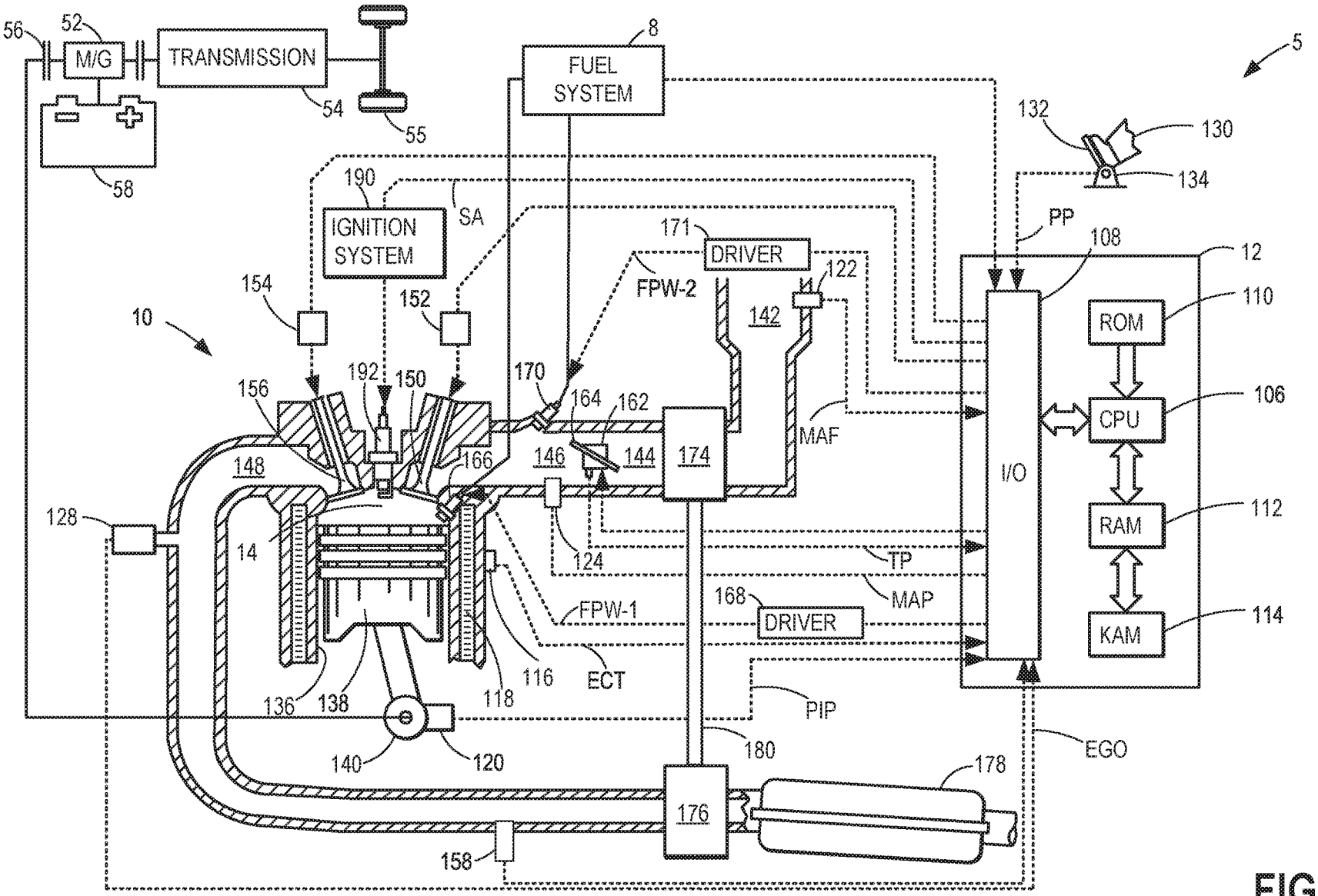
FIG. 1 shows an example of an engine system adapted with a positive crankcase ventilation (PCV) system.

Turning now to FIG. 1, an example of a cylinder 14 of an internal combustion engine 10 is illustrated, which may be included in a vehicle 5. Engine 10 may be controlled at least partially by a control system, including a controller 12, and by input from a vehicle operator 130 via an input device 132. In this example, input device 132 includes an accelerator pedal and a pedal position sensor 134 for generating a proportional pedal position signal PP. Cylinder (herein, also "combustion chamber") 14 of engine 10 may include combustion chamber walls 136 with a piston 138 positioned therein. Piston 138 may be coupled to a crankshaft 140 so that reciprocating motion of the piston is translated into rotational motion of the crankshaft. Crankshaft 140 may be coupled to at least one drive wheel 55 of the passenger vehicle via a transmission 54, as described further below. Further, a starter motor (not shown) may be coupled to crankshaft 140 via a flywheel to enable a starting operation of engine 10.

In some examples, vehicle 5 may be a hybrid vehicle with multiple sources of torque available to one or more vehicle wheels 55. In other examples, vehicle 5 is a conventional vehicle with only an engine. In the example shown, vehicle 5 includes engine 10 and an electric machine 52. Electric machine 52 may be a motor or a motor/generator. Crankshaft 140 of engine 10 and electric machine 52 are connected via transmission 54 to vehicle wheels 55 when one or more clutches 56 are engaged. In the depicted example, a first clutch 56 is provided between crankshaft 140 and electric machine 52, and a second clutch 56 is provided between electric machine 52 and transmission 54. Controller 12 may send a signal to an actuator of each clutch 56 to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from a traction battery 58 to provide torque to vehicle wheels 55. Electric machine 52 may also be operated as a generator to provide electrical power to charge battery 58, for example, during a braking operation.

Cylinder 14 of engine 10 can receive intake air via a series of intake air passages 142, 144, and 146. Intake air passage 146 can communicate with other cylinders of engine 10 in addition to cylinder 14. In some examples, one or more of the intake passages may include a boosting device, such as a turbocharger or a supercharger. For example, FIG. 1 shows engine 10 configured with a turbocharger, including a compressor 174 arranged between intake passages 142 and 144 and an exhaust turbine 176 arranged along an exhaust passage 148. Compressor 174 may be at least partially powered by exhaust turbine 176 via a shaft 180 when the boosting device is configured as a turbocharger. However, in other examples, such as when engine 10 is provided with a supercharger, compressor 174 may be powered by mechanical input from a motor or the engine and exhaust turbine 176 may be optionally omitted.

A throttle 162 including a throttle plate 164 may be provided in the engine intake passages for varying the flow rate and/or pressure of intake air provided to the engine cylinders. For example, throttle 162 may be positioned downstream of compressor 174, as shown in FIG. 1, or may be alternatively provided upstream of compressor 174.

Exhaust passage 148 can receive exhaust gases from other cylinders of engine 10 in addition to cylinder 14. An exhaust gas sensor 128 is shown coupled to exhaust passage 148 upstream of an emission control device 178. Exhaust gas sensor 128 may be selected from among various suitable sensors for providing an indication of exhaust gas air/fuel ratio (AFR), such as a linear oxygen sensor or UEGO (universal or wide-range exhaust gas oxygen), a two-state oxygen sensor or EGO (as depicted), a HEGO (heated EGO), a NOx, a HC, or a CO sensor, for example. Emission control device 178 may be a three-way catalyst, a NOx trap, various other emission control devices, or combinations thereof.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder. Intake valve 150 may be controlled by controller 12 via an actuator 152. Similarly, exhaust valve 156 may be controlled by controller 12 via an actuator 154. The positions of intake valve 150 and exhaust valve 156 may be determined by respective valve position sensors (not shown).

During some conditions, controller 12 may vary the signals provided to actuators 152 and 154 to control the opening and closing of the respective intake and exhaust valves. The valve actuators may be of an electric valve actuation type, a cam actuation type, or a combination thereof. The intake and exhaust valve timing may be controlled concurrently, or any of a possibility of variable intake cam timing, variable exhaust cam timing, dual independent variable cam timing, or fixed cam timing may be used. Each cam actuation system may include one or more cams and may utilize one or more of cam profile switching (CPS), variable cam timing (VCT), variable valve timing (VVT), and/or variable valve lift (VVL) systems that may be operated by controller 12 to vary valve operation. For example, cylinder 14 may alternatively include an intake valve controlled via electric valve actuation and an exhaust valve controlled via cam actuation, including CPS and/or VCT. In other examples, the intake and exhaust valves may be controlled by a common valve actuator (or actuation system) or a variable valve timing actuator (or actuation system).

Cylinder 14 can have a compression ratio, which is a ratio of volumes when piston 138 is at bottom dead center (BDC) to top dead center (TDC). In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some examples, each cylinder of engine 10 may include a spark plug 192 for initiating combustion. An ignition system 190 can provide an ignition spark to combustion chamber 14 via spark plug 192 in response to a spark advance signal SA from controller 12, under select operating modes. A timing of signal SA may be adjusted based on engine operating conditions and driver torque demand. For example, spark may be provided at maximum brake torque (MBT) timing to maximize engine power and efficiency. Controller 12 may input engine operating conditions, including engine speed, engine load, and exhaust gas AFR, into a look-up table and output the corresponding MBT timing for the input engine operating conditions. In other examples the engine may ignite the charge by compression as in a diesel engine.

In some examples, each cylinder of engine 10 may be configured with one or more fuel injectors for providing fuel thereto. As a non-limiting example, cylinder 14 is shown including a fuel injector 166. Fuel injector 166 may be configured to deliver fuel received from a fuel system 8. Fuel system 8 may include one or more fuel tanks, fuel pumps, and fuel rails. Fuel injector 166 is shown coupled directly to cylinder 14 for injecting fuel directly therein in proportion to the pulse width of a signal FPW-1 received from controller 12 via an electronic driver 168. In this manner, fuel injector 166 provides what is known as direct injection (hereafter also referred to as "DI") of fuel into cylinder 14. While FIG. 1 shows fuel injector 166 positioned to one side of cylinder 14, fuel injector 166 may alternatively be located overhead of the piston, such as near the position of spark plug 192. Such a position may increase mixing and combustion when operating the engine with an alcohol-based fuel due to the lower volatility of some alcohol-based fuels. Alternatively, the injector may be located overhead and near the intake valve to increase mixing. Fuel may be delivered to fuel injector 166 from a fuel tank of fuel system 8 via a high pressure fuel pump and a fuel rail. Further, the fuel tank may have a pressure transducer providing a signal to controller 12.

Fuel injector 170 is shown arranged in intake passage 146, rather than in cylinder 14, in a configuration that provides what is known as port fuel injection (hereafter referred to as "PFI") into the intake port upstream of cylinder 14. Fuel injector 170 may inject fuel, received from fuel system 8, in proportion to the pulse width of signal FPW-2 received from controller 12 via electronic driver 171. Note that a single driver 168 or 171 may be used for both fuel injection systems, or multiple drivers, for example driver 168 for fuel injector 166 and driver 171 for fuel injector 170, may be used, as depicted.

In an alternate example, each of fuel injectors 166 and 170 may be configured as direct fuel injectors for injecting fuel directly into cylinder 14. In still another example, each of fuel injectors 166 and 170 may be configured as port fuel injectors for injecting fuel upstream of intake valve 150. In yet other examples, cylinder 14 may include only a single fuel injector that is configured to receive different fuels from the fuel systems in varying relative amounts as a fuel mixture, and is further configured to inject this fuel mixture either directly into the cylinder as a direct fuel injector or upstream of the intake valves as a port fuel injector.

Fuel may be delivered by both injectors to the cylinder during a single cycle of the cylinder. For example, each injector may deliver a portion of a total fuel injection that is combusted in cylinder 14. Further, the distribution and/or relative amount of fuel delivered from each injector may vary with operating conditions, such as engine load, knock, and exhaust temperature, such as described herein below. The port injected fuel may be delivered during an open intake valve event, closed intake valve event (e.g., substantially before the intake stroke), as well as during both open and closed intake valve operation. Similarly, directly injected fuel may be delivered during an intake stroke, as well as partly during a previous exhaust stroke, during the intake stroke, and partly during the compression stroke, for example. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

Fuel injectors 166 and 170 may have different characteristics. These include differences in size, for example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among injectors 170 and 166, different effects may be achieved.

Fuel tanks in fuel system 8 may hold fuels of different fuel types, such as fuels with different fuel qualities and different fuel compositions. The differences may include different alcohol content, different water content, different octane, different heats of vaporization, different fuel blends, and/or combinations thereof etc. One example of fuels with different heats of vaporization could include gasoline as a first fuel type with a lower heat of vaporization and ethanol as a second fuel type with a greater heat of vaporization. In another example, the engine may use gasoline as a first fuel type and an alcohol containing fuel blend such as E85 (which is approximately 85% ethanol and 15% gasoline) or M85 (which is approximately 85% methanol and 15% gasoline) as a second fuel type. Other feasible substances include water, methanol, a mixture of alcohol and water, a mixture of water and methanol, a mixture of alcohols, etc.

Controller 12 is shown in FIG. 1 as a microcomputer, including a microprocessor unit 106, input/output ports 108, an electronic storage medium for executable programs (e.g., executable instructions) and calibration values shown as non-transitory read-only memory chip 110 in this particular example, random access memory 112, keep alive memory 114, and a data bus. Controller 12 may receive various signals from sensors coupled to engine 10, including signals previously discussed and additionally including a measurement of inducted mass air flow (MAF) from a mass air flow sensor 122; an engine coolant temperature (ECT) from a temperature sensor 116 coupled to a cooling sleeve 118; an exhaust gas temperature from a temperature sensor 158 coupled to exhaust passage 148; a profile ignition pickup signal (PIP) from a Hall effect sensor 120 (or other type) coupled to crankshaft 140; throttle position (TP) from a throttle position sensor; signal EGO from exhaust gas sensor 128, which may be used by controller 12 to determine the AFR of the exhaust gas; and an absolute manifold pressure signal (MAP) from a MAP sensor 124. An engine speed signal, RPM, may be generated by controller 12 from signal PIP. The manifold pressure signal MAP from MAP sensor 124 may be used to provide an indication of vacuum or pressure in the intake manifold. Controller 12 may infer an engine temperature based on the engine coolant temperature and infer a temperature of catalyst 178 based on the signal received from temperature sensor 158.

Controller 12 receives signals from the various sensors of FIG. 1 and employs the various actuators of FIG. 1 to adjust engine operation based on the received signals and instructions stored on a memory of the controller. For example, upon receiving a signal from the exhaust gas sensor 128, the controller 12 may command adjustments, e.g., advance or retard, to a spark timing to accommodate variations in the AFR based upon estimates of oxygen content in the exhaust gas. Spark may be retarded if the AFR becomes more lean and alternatively, may be advanced if the AFR becomes more rich.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

Another example configuration of a multi-cylinder engine system 200 is depicted in FIG. 2, which may be included in a propulsion system of an automobile. Engine system 200 may be controlled at least partially by a control system 202 including controller 12 and by input from a vehicle operator via an input device, such as input device 132 of FIG. 1. Control system 202 is shown receiving information from a plurality of sensors 208 (various examples of which are described for FIG. 1 and herein) and sending control signals to a plurality of actuators 210, such as the various actuators shown in FIG. 1. As one example, sensors 208 may include an engine coolant (ECT) sensor 238, an exhaust gas sensor 252, a pressure sensor 268, a barometric pressure (BP) sensor 270, a compressor inlet pressure (CIP) sensor 272, a MAP sensor 274, and a crankcase pressure sensor 276. As another example, actuators 210 may include fuel injectors, such as fuel injectors 166 and 170 of FIG. 1, and throttle 236. Other actuators, such as a variety of additional valves and throttles, may be coupled to various locations in engine system 200. Controller 12 may receive input data from the various sensors, process the input data, and trigger the actuators in response to the processed input data based on instruction or code programmed therein corresponding to one or more routines.

Engine 200 may include a lower portion of the engine block, indicated generally at 212, which may include a crankcase 214 encasing a crankshaft 216. Crankcase 214 contains gas and may include an oil sump 218, otherwise referred to as an oil well, holding engine lubricant (e.g., oil) positioned below the crankshaft 216. An oil fill port 220 may be disposed in crankcase 214 so that oil may be supplied to oil sump 218. Oil fill port 220 may include an oil cap 222 to seal oil fill port 220 when the engine is in operation. A dip stick tube 224 may also be disposed in crankcase 214 and may include a dipstick 226 for measuring a level of oil in oil sump 218. In addition, crankcase 214 may include a plurality of other orifices for servicing components in crankcase 214. These orifices in crankcase 214 may be maintained closed during engine operation so that a crankcase ventilation system (described below) may operate during engine operation.

The upper portion of engine block 212 may include a combustion chamber (e.g., cylinder) 228, which may also be cylinder 14 of FIG. 1. The combustion chamber 228 may include combustion chamber walls 230 with piston 232 positioned therein. Piston 232 may be coupled to crankshaft 216 so that reciprocating motion of the piston is translated into rotational motion of the crankshaft. Combustion chamber 228 may receive fuel from fuel injectors (not shown) and intake air from intake manifold 234 which is positioned downstream of throttle 236. The engine block 212 may also include engine coolant temperature (ECT) sensor 238 input into controller 12.

Throttle 236 may be disposed in the engine intake to control the airflow entering intake manifold 234 and may be preceded upstream by compressor 240 followed by charge air cooler 242, for example. Compressor 240 may compress the intake air to engine 200, thereby boosting intake air pressure and density providing boosted engine conditions (e.g., manifold air pressure>barometric pressure), for example during increased engine loads. An air filter 244 may be positioned upstream of compressor 240 and may filter fresh air entering intake passage 246.

Exhaust combustion gases exit the combustion chamber 228 via exhaust passage 248 located upstream of turbine 250. An exhaust gas sensor 252 may be disposed along exhaust passage 248 upstream of turbine 250. Turbine 250 may be equipped with a wastegate (not shown) bypassing it, and turbine 250 may be driven by the flow of exhaust gases. Furthermore, turbine 250 may be mechanically coupled to compressor 240 via a common shaft (not shown), such that rotation of turbine 250 may drive compressor 240. Sensor 252 may be a suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor. Exhaust gas sensor 252 may be connected with controller 12.

In the example of FIG. 2, a positive crankcase ventilation system (PCV) 254 is coupled to the engine fresh air intake 256 so that gases in crankcase 214 may be vented in a controlled manner. During normal engine operation, gases in the combustion chamber 228 may escape past the piston. These blow-by gases may include unburned fuel, combustion products, and air. Blow-by gases may dilute and contaminate oil, causing corrosion to engine components and contributing to sludge build-up, reducing the protective and lubricating properties of the oil. At higher engine speeds, blow-by gases may increase crankcase pressure such that oil leakage may occur from sealed engine surfaces. The PCV system 254 may help to vent and remove blow-by gases from the engine crankcase in a controlled manner in order to mitigate the degrading effects of blow-by gases and may combine the gases with an engine intake stream so that the gases may be combusted within the engine. By redirecting blow-by gases to the engine intake, the PCV system 254 aids in reducing engine emissions by precluding venting of blow-by gases to the atmosphere.

The PCV system 254 includes a PCV valve 258, arranged in a crankcase ventilation (vent) tube 260, that is fluidly coupled to the engine crankcase 214. As an example, the PCV valve 258 may be coupled to a valve cover in the engine, which may allow for the PCV system to draw blow-by gases from the engine while reducing the entrainment of oil from the crankcase. The PCV valve 258 may also be fluidly coupled to the engine intake manifold 234. The PCV valve gas flow rate may vary with engine conditions such as engine speed and load, and the PCV valve 258 may be calibrated for a particular engine application where the PCV valve gas flow rate may be adjusted as operating conditions change. As another example, when the engine is off, the PCV valve 258 may be closed and no gases may flow through. When the engine speed is idling or low, or during deceleration when the intake manifold vacuum is relatively high, the PCV valve 258 may open slightly, allowing for restricted PCV valve gas flow rates. At engine speeds or loads higher than idling, intake manifold vacuum may lower and the opening of PCV valve 258 may increase to allow higher PCV valve gas flow rates. PCV valve 258 may include a conventional PCV valve or a push-pull type PCV valve.

The PCV valve 258 is positioned in the crankcase ventilation tube 260 downstream of an oil separator 262. The oil separator 262 removes entrained oil from gases vented from the crankcase 214 and flowing through the crankcase ventilation tube 260 before the gases are delivered to the engine intake. A first end 264 of crankcase ventilation tube 260 is fluidly coupled to the crankcase 214, providing a flow path for gases accumulated in the crankcase 214 to escape. Crankcase gases may flow from the first end 264 of crankcase ventilation tube 260, through the oil separator 262 and PCV valve 258, to a second end 266 of crankcase ventilation tube 260 (also a PCV outlet). The second end 266 may be fluidly coupled to the fresh air intake 256, downstream of the air filter 244 and upstream of the compressor 240. In other examples, the second end 266 of crankcase ventilation tube 260 may be coupled to the intake passage 246 upstream of the air filter 244. Gases from the crankcase 214 may thus be channeled to the engine intake through the crankcase ventilation tube 260.

In other examples, the PCV system 254 may include multiple crankcase ventilation tubes, or ducts, fluidly coupling various regions of the crankcase 214 to the oil separator 262. Examples of PCV systems with multiple ducts are shown in FIGS. 3-7, that include a ducted plenum with ducts that couple to specific cylinder bays to vent blow-by gases from engine cylinders. Details of the ducted plenum will be discussed further below.

In some embodiments, crankcase ventilation tube 260 may include pressure sensor 268 coupled therein. Pressure sensor 268 may be an absolute pressure sensor or a gauge sensor. One or more additional pressure and/or flow sensors may be coupled to the PCV system 254 at alternate locations. For example, the barometric pressure sensor (BP sensor) 270 may be coupled to intake passage 246, upstream of air filter 244, for providing an estimate of barometric pressure (BP). In one example, where pressure sensor 268 is configured as a gauge sensor, BP sensor 270 may be used in conjunction with pressure sensor 268. In some embodiments, compressor inlet pressure (CIP) sensor 272 may be coupled in intake passage 246 downstream of air filter 244 and upstream of compressor 240 to provide an estimate of the compressor inlet pressure (CIP).

The PCV system 254 vents air out of crankcase 214 and into intake manifold 234 to provide continual evacuation of gases from inside the crankcase 214 to the intake manifold 234. In one embodiment, the PCV valve 258 may vary its flow restriction in response to the pressure drop across it (or flow rate through it). In still other examples, the PCV valve 258 may be an electronically controlled valve that is controlled by controller 12. It will be appreciated that, as used herein, PCV flow refers to the flow of blow-by gases through the crankcase vent tube 260 from the crankcase 214 to the intake manifold 234. As an example, the PCV flow may be determined from the fuel (e.g., gaseous fuel) injection rate, the air/fuel ratio in the engine intake, and the exhaust oxygen content via exhaust gas sensor 252, using known methods.

In some examples, PCV system 254 may be equipped with a check valve for preventing PCV backflow. It will be appreciated that while the depicted example shows PCV valve 258 as a passive valve, this is not meant to be limiting, and in alternate embodiments, PCV valve 258 may be an electronically controlled valve (e.g., a powertrain control module (PCM) controlled valve) wherein a controller 12 of control system 202 may command a signal to change a position of the valve from an open position (or a position of high flow) to a closed position (or a position of low flow), or vice versa, or any position there-between.

The gases in crankcase 214 may include un-burned fuel, un-combusted air, and fully or partially combusted gases. As described above, lubricant mist may also be present. As such, various oil separators may be incorporated in PCV system 254 to reduce exiting of the oil mist from the crankcase 214 through the PCV system 254. While one oil separator (oil separator 262) is shown in FIG. 2, other examples of engine 200 may include multiple oil separators arranged in crankcase ventilation tube 260. Furthermore, while a single crankcase vent tube 260 is depicted in FIG. 2, coupled to a crankcase bay surrounding combustion chamber 228, in engine systems with multiple combustion chambers may include several crankcase vent tubes, each coupled to one or more cylinder bays, through the crankcase, surrounding individual combustion chambers. In some examples, the crankcase vent tubes may merge into a single conduit or chamber upstream of the oil separator (and PCV valve) to allow gases from each cylinder bay to combine into a single mass before passing through the oil separator.

Under certain conditions, the PCV system 254 may be monitored by a variety of sensors in the PCV system 254. In some embodiments, a plurality of absolute sensors, e.g., the barometric pressure sensor (BP) 270, the compressor inlet pressure sensor (CIP) 272, intake manifold pressure (MAP) sensor 274, crankcase pressure sensor 276 and/or the pressure sensor 268 in the crankcase ventilation tube 260, may be used in combination to monitor PCV system pressure. For example, in some approaches, the BP sensor 270, the CIP sensor 272, and the pressure sensor 268 in the PCV crankcase ventilation tube 260 may all be used to monitor PCV system pressure.

By adapting an engine with a PCV system, e.g., the PCV system 254 of FIG. 2, pressure accumulation in a crankcase may be alleviated and engine oil performance may be preserved and prolonged. However, an efficiency of the PCV system in removing entrained oil mist from gases vented out of the crankcase, before the gases are delivered to the engine intake, may be dependent upon a configuration of the PCV system relative to a geometry of the engine. As described above, the PCV system may include more than one crankcase ventilation tube or duct, ducts merging into a single chamber or conduit at a point upstream of the oil separator to combine the gases evacuated from combustion chambers into surrounding cylinders bays and down, through the crankcase, the crankcase positioned below and fluidly coupled to the cylinder bays. The merging of gases vented through the crankcase may incur a high degree of turbulence in the merging region upstream of an oil separator due to differences in phasing, and thus pressure signatures, amongst the combustion chambers of the engine. In spite of the presence of the oil separator in the PCV system, turbulence in the gases may allow a portion of the oil entrained in the gases to pass through the oil separator into an intake manifold of the engine, thereby increasing a likelihood of engine misfire.

Turbulence in PCV flow may be dampened by configuring the PCV system with a ducted plenum. The ducted plenum may include ducts that couple to targeted regions of a crankcase and may be casted directly into the crankcase. As such, the ducted plenum may be formed from a similar material as the crankcase. An interior of the crankcase, housing parts such as a crankshaft, connecting rods, bearings, etc., may be divided into chambers by components such as flywheels, each chamber fluidly coupled to a cylinder bay of a cylinder. The cylinder bay may be a chamber in an upper region of the crankcase, directly below the cylinder. Each cylinder bay in the upper region of the crankcase may be directly and/or fluidly coupled to interior chambers of the crankcase, each chamber positioned directly below each cylinder bay with free exchange of gases between the cylinder bay and the chamber below. Thus gases generated in one of the cylinders may flow out past a piston, down into the cylinder bay, and into the chamber of the crankcase that is coupled to the cylinder bay, as shown in FIG. 9 and discussed further below.

The coupling of one of the ducts to one of the interior chambers of the crankcase, through the crankcase, may vent blow-by gases from a specific cylinder. The duct may be casted into the crankcase, with some regions protruding from an outer surface of the crankcase and some regions integrated into a wall of the crankcase to provide a path for blow-by gases, originating from the cylinder, to flow from the cylinder, into the cylinder bay and associated crankcase chamber, and through the duct. The points at which the ducts connect to the crankcase, each duct fluidly coupled to at least one cylinder bay through the crankcase, relative to a height of the crankcase, may determine a flow rate of gases into the ducts.

For example, a gas flow velocity in the cylinder bay may be highest at an upper region of the crankcase, proximate to a bottom portion of a combustion chamber, e.g., adjacent to a bottom end of a piston when the piston is BDC. The gas flow velocity may decrease with depth, in a downwards direction along the crankcase. The flow of gases into the ducts of the ducted plenum may be regulated by adjusting a positioning of the regions where the ducts couple to the cylinder bays along the height of the crankcase. By coupling one of the ducts to a point along one of the cylinder bays at the upper portion of the crankcase, vented gas flowing into the duct may have a higher velocity than a duct coupled to a point near a bottom of the crankcase.

In addition to the positioning of the coupling points of the ducts along the crankcase, relative to each cylinder bay, the velocity of gases in each duct may be regulated by dimensions of the ducts. As an example, a narrower duct may increase flow velocity as well as friction-generated turbulence relative to a wider duct. As another example, a longer duct may reduce the velocity of the gases at the merging region of the ducted plenum compared to a shorter duct. In some examples, a desired PCV flow velocity may be achieved by adjusting a combination of a position where the duct is coupled to the crankcase, a length of the duct, and a diameter of the duct.

By controlling a flow velocity of blow-by gases through each of the ducts, the gases may combine in a merging region of the ducted plenum in a dampened, more quiescent state, allowing the oil separator to more effectively remove oil from the vented gases. The geometry of the ducted plenum may vary depending on a geometry of the engine. An example of a ducted plenum 300, that may be used as the PCV ventilation system 254 of FIG. 2, adapted to couple to a crankcase of an engine configured with four inline cylinders, is shown in FIGS. 3-5.

The ducted plenum 300 is shown on its own in FIG. 3 to show details of a geometry and dimensions of the ducted plenum 300. Coupling of the ducted plenum 300 to a four cylinder inline engine is depicted in FIGS. 4 and 5, showing a positioning of the ducted plenum 300 from a perspective view in FIG. 4 and a cross-sectional profile view in FIG. 5. An engine block, configured to surround combustion chambers of the engine, and an outer wall of the crankcase, enclosing inner elements of the crankcase and positioned below the combustion chambers, are omitted in FIGS. 4-5 for simplicity but will be included in descriptions of FIGS. 3-5 to provide references for orientation of engine components and gas flows.

The ducted plenum 300, depicted in FIG. 3, may be shaped as a cross, with appendages extending away from a central merging chamber 302 (also referred to herein as the central chamber), the region encompassed by the central merging chamber 302 indicated by a dashed ellipse. The appendages may include an upper chamber 304 and a plurality of ducts, including a first duct 306, a second duct 318, and a third duct 326. A set of reference axes 301 are provided, indicating a y-axis, a z-axis, and an x-axis. The central merging chamber 302 may be a hollow compartment that is fluidly coupled to each of the appendages extending from the central merging chamber 302. The central merging chamber may include first section 302*a* and a second section 302*b*, the first section 302*a* above the second section 302*b* along the y-axis. The inner compartment of the central merging chamber 302 may be continuous through the first and second sections 302*a*, 302*b*. The first section 302*a* may have linear, e.g., parallel with the y-axis, front and back surfaces while the second section 302*b* may extend at an angle or curve outwards, away from the crankcase, as shown in a cross-section 500 of FIG. 5. The first section 302*a* and second section 302*b* may be seamlessly coupled or attached by a welded joint.

Apertures 303 that are through-holes may be disposed in the central merging chamber 302 to accommodate a protrusion of bosses from a crankcase while maintaining an alignment of the ducted plenum 300 along the crankcase. An upper chamber 304 is arranged above, with respect to the y-axis, which may be referred to as a vertical axis, the central merging chamber 302, coupled to a top edge 334 of the first section 302*a* of the central merging chamber 302, and may house a PCV outlet that couples to an engine intake system, a PCV valve and an oil separator, such as the PCV valve 258 and oil separator 262 of FIG. 2, where the oil separator is arranged upstream of the PCV valve and the PCV valve is upstream of the PCV outlet. The upper chamber 304 may also enclose a conduit that fluidly couples the central merging chamber 302 to the oil separator and the oil separator to the PCV valve.

A first duct 306 may extend along the z-axis from a left-hand (e.g., first) side 307 of the first section 302*a* of the central merging chamber 302 and across a width, defined along the z-axis of a first cylinder bay (not shown in FIG. 3) to couple to the first cylinder bay through the crankcase. In comparison to the upper chamber 304, the first duct may be elongate and relatively narrow in height and width, compared to a length 309 of the first duct 306, with the length 309 of the first duct 306 measured along the z-axis, a height 308 measured along the y-axis and a width 310 measured along the x-axis. The height 308 and width 310 may be uniform along the length 309 of the first duct 306. The height 308 may be larger than the width 310 so that an outward protrusion of the first duct 306, along the x-axis and away from the first cylinder bay, is reduced while maintaining a desired inner volume of the first duct 306.

The first duct 306 may include outwardly, e.g., in a direction away from the cylinder and cylinder bay as indicated by arrows 321, curving sections 312 to accommodate piston squirters arranged around the first cylinder bay. The outwardly curving sections 312 may be separated by non-protruding, linear sections 323 that are parallel with the z-axis. Thus the first duct 306 may be composed of an alternating pattern of outwardly curving sections 312 and linear sections 323, comprising multiple curving sections 312 and multiple linear sections 323 along the length 309 of the first duct 306. As shown in a cross-section 500 in FIG. 5, the outwardly curving sections 312 may protrude outwards beyond an outer surface of the first section 302*a* of the central merging chamber 302.

A first end 314 of the first duct 306 is directly coupled to the central merging chamber 302 and a second end 316 of the first duct 306 may include an opening 305. The opening 305 at the second end 316 may be disposed along a lower edge 315 of the first duct 306 so that the opening 305 at the second end 316 is perpendicular to an opening at the first end 314 that couples to the central merging chamber 302. The opening 305 at the second end 316 may be coupled to an opening or port in an upper surface of the crankcase. The opening 305 may allow the first duct 306 to be fluidly coupled to the first cylinder bay through the crankcase so that fluids (e.g., gases) may pass from the first cylinder by to the first duct 306 and into the central merging chamber 302.

A second duct 318 may be positioned on a right-hand (e.g., second) side 311 of the first section 302*a* of the central merging chamber 302, opposite of the first duct 306, and also extending away from the central merging chamber 302 along the z-axis and across a width of a fourth cylinder bay (not shown in FIG. 3), the width defined along the z-axis. An alignment of the second duct 318 along the y-axis relative to the central merging chamber 302 may be offset and higher, along the y-axis, than an alignment of the first duct 306. For example, the second duct 318 directly couples to the central merging chamber 302 at a position, along the y-axis, that is higher than and offset from where the first duct 306 couples to the central merging chamber 302. The second duct 318 may have a height and width along the y-axis and x-axis that are similar to the height 308 and width 310 of the first duct 306. A length 313 of the second duct 318, however, may be shorter than the length 309 of the first duct 306. A difference in lengths between the first duct 306 and the second duct 318 may be due to a positioning of the central merging chamber 302 of the ducted plenum 300 biased towards the fourth cylinder bay.

For example, as shown in FIG. 4, the central merging chamber 302 may be arranged so the first side 307 of the first section 302*a* of the central merging chamber 302 is closer to the second end 316 of the first duct 306 than the second side 311 of the first section 302*a* of the central merging chamber 302 to the second end 324 of the second duct 318. As such, the central merging chamber 302 may be positioned in front of a second cylinder 406 and a third cylinder 408 so that a greater portion of a width, defined along the z-axis, of the central merging chamber 302 overlaps with the second cylinder 406 than the third cylinder 408.

Returning to FIG. 3, the second duct 318 may also include outwardly, e.g., in a direction away from the fourth cylinder and fourth cylinder bay as indicated by arrows 325, protruding sections 320 that alternate with at least one non-protruding, linear section 327 along the length 313 of the second duct 318 to accommodate piston squirters surrounding the fourth cylinder bay. Similar to the first duct 306, a first end 322 of the second duct 318 is directly coupled to the central merging chamber 302 and a second end 324 of the second duct 318 may include an opening 319 that is perpendicularly to an opening in the first end 322 where the first end 322 couples to the second side 311 of the first section 302*a* of the central merging chamber 302. The opening 319 may be disposed in a lower edge 317 of the second duct 318 to couple to a port in the upper surface of the crankcase. The opening 319 at the second end 324 may allow the second duct 318 to be fluidly coupled to the fourth cylinder bay through the crankcase and may be arranged higher, along the y-axis, than the opening 305 at the second end 316 of the first duct 306.

A third duct 326 may extend downwards, with respect to the y-axis, from a bottom edge 332 of the central merging chamber 302, opposite of the upper chamber 304, and along a height of the crankcase, the height defined along the y-axis. For example, as shown in FIGS. 4 and 5, the third duct 326 extends from a top of the crankcase to a bottom of the crankcase, along an entire height of the crankcase. A length 336 of the third duct 326, measured along the y-axis, may be similar to the length of the second duct 318. The third duct 326 may have a width, defined along the z-axis that is wider at a first end 328 and tapers to become more narrow at a second end 330, the first end 328 positioned above the second end 330 relative to the y-axis. A depth of the third duct 326, measured along the x-axis, may be smaller than the width of the third duct 326 and similar in size to the width 310 of the first duct 306. As shown in FIG. 5, the third duct 326 may include a planar section 338 that is aligned with the y-axis and an inwardly, e.g., in a direction towards the cylinders and cylinder bays, curving section 340 that couples the second end 330 of the third duct 326 to the bottom of the crankcase, above an oil sump 416.

The first end 328 of the third duct 326 may be fluidly coupled to the central merging chamber 302 and the second end 330 may include an opening 329. The opening 329 at the second end 330 may allow the third duct 326 to be fluidly coupled to both the second and third cylinder bays, through the crankcase at the bottom of the crankcase. Gases accumulated in the crankcase from the second and third cylinder bays may thereby escape through the third duct 326, flowing from the second end 330 to the first end 328 and into the central merging chamber 302. Similarly, pressure in the crankcase arising from blow-by gases flowing from the first cylinder bay may be relieved by directing gases from the first cylinder bay into the first duct 306, flowing from the second end 316 to the first end 314, and into the central merging chamber 302. Pressure in the crankcase from blow-by gases of the fourth cylinder bay may be alleviated gas ventilation through the second duct 318, from the second end 324 to the first end 322, and also into the central merging chamber 302.

The central merging chamber 302 may provide a region where gas flows from each of the first, second, and third ducts 306, 318, and 326 may combine and mix prior to delivery to the engine intake via the flow path through the oil separator and PCV valve. A timing of gas flows from each of the ducts into the central merging chamber 302 of the ducted plenum 300 may vary depending on combustion chamber phasing and may affect a pressure profile of the central merging chamber 302. In addition, dimensions of each of the ducts may affect flow velocities through the ducts, determining an amount of turbulence in the central merging chamber 302 based on differences in flow velocities between the ducts. The pressure profile may impact how effectively the central merging chamber 302 reduces turbulence in the mixture of gases collected within the central merging chamber 302. The effects of a geometry of the ducted plenum is described in further detail by an example shown in FIGS. 4-5 and 9 of how the ducted plenum may couple to an engine.

The coupling of the ducted plenum 300 to an inline four cylinder (I4) engine 400 is shown in FIGS. 4, 5 and 9 without the outer walls of a crankcase 403 or engine block for simplicity. Elements of FIG. 4, as well as FIGS. 5 and 9 that are in common with those of FIG. 3 are similarly numbered and will not be re-introduced. The engine 400 includes a central axis 401 that is perpendicular to a cylinder axis 402 (e.g., the cylinder axis 402 runs through a center of cylinder 404 but is parallel to a similar cylinder axis of the other cylinders of the engine), the central axis 401 defining an alignment of a crankshaft within the crankcase 403 (e.g., the central axis 401 is a central axis of the crankshaft). The ducted plenum 300 may be positioned relative to I4 engine 400 so that the third duct 326 is aligned parallel with a cylinder axis 402 of the I4 engine 400. The first duct 306 of the ducted plenum 300 extends across a width, the width parallel with the central axis 401, of a first cylinder 404. The third duct 326 extends along a lower portion of a height, defined along the y-axis, of the I4 engine 400, in front of the second cylinder 406 and the third cylinder 408, on the one side of the engine. The second duct 318 extends along a width, also defined along the central axis 401, of a fourth cylinder 410.

Components enclosed by the crankcase 403, e.g., elements shown below the cylinders in FIG. 4, such as flywheels, may separate the crankcase interior into distinct sections so that blow-by gases from each cylinder may be channeled down through each cylinder bay into individual sections of the crankcase 403 without mixing. In this way, blow-by gases from each cylinder remain isolated from gases from adjacent interior sections of the crankcase 403 and are delivered to the central merging chamber 302 of the ducted plenum 300 by the duct to which each cylinder is coupled.

Each of the first duct 306, second duct 318, and third duct 326 may be fluidly coupled to one or more cylinders of the I4 engine 400 through the wall of the crankcase 403 at respective second ends 316, 324, 330 of the ducts. As shown in FIG. 4, the first duct 306 is coupled to a first cylinder bay 418 surrounding the first cylinder 404 at the second end 316 of the first duct 306. The horizontally-aligned (e.g., perpendicular to the cylinder axis 402) opening 305 at the second end 316 of the first duct 306 is directly coupled to a top 420 of the crankcase 403 which is fluidly coupled to the first cylinder bay 418 that surrounds the first cylinder 404. Similarly, as shown in FIG. 4, the second duct 318 is coupled to a fourth cylinder bay 422, surrounding the fourth cylinder 410, at the second end 324 of the second duct 318. The opening 319 at the second end 324 of the second duct 318 is horizontal, e.g., perpendicular to the cylinder axis 402, and directly coupled to the top 420 of the crankcase 403 which is fluidly coupled to the fourth cylinder bay 422.

Additionally, as shown in FIG. 4, the third duct 326 is coupled to both a second cylinder bay 424 and a third cylinder bay 426 that surround the second cylinder 406 and the third cylinder 408, respectively. The third duct 326 may also have the horizontally-aligned opening 329 at the second end 330 connecting to a bottom 430 of the crankcase 403, above the oil sump 416. The opening 329 of the third duct 326 may directly couple to interior chambers of the crankcase 403 through the wall of the crankcase 403, the interior chambers fluidly coupled to the second cylinder bay 424 and third cylinder bay 426 and thereby fluidly coupling the third duct 326 to the second and third cylinder bays 424, 426.

A cross-section 500 of the I4 engine 400 is shown in FIG. 5. The cross-section 500 is taken along line A-A' shown in FIG. 4, along a y-x plane and shows the alignment of the ducted plenum 300 relative to a front side of the I4 engine 400. The third cylinder 408 is depicted above a flywheel 502 that is coupled to a crankshaft, the flywheel 502 and crankshaft both enclosed within the crankcase. The central merging chamber 302 is arranged below the upper chamber 304 and has a depth 502, measured along the x-axis, that is much smaller than a depth 504 of the upper chamber 304. The upper chamber 304 is positioned above the top 420 of the crankcase 403.

The first section 302*a* of the central merging chamber 302, positioned above the second section 302*b*, may have front and back surfaces that are parallel with the cylinder axis 402 and have a height 506 that is smaller than a height 508 of the second section 504. The second section 302*b* may have front and back surfaces that extend outward along the x-axis at an angle to the cylinder axis 402, away from the flywheel as the second section 302*b* extends downwards and away from the first section 302*a*. The second section 302*b* may curve at a bottom end 510 where the second 302*b* merges with a first end 328 of the third duct 326.

The third duct 326 extends a distance 512 from the bottom end 510 of the second section 302*b* of the central merging chamber 302 to the bottom 430 of the crankcase 403. The distance 512 that the third duct 326 extends along the y-axis includes the planar section 338, with surfaces parallel with the y-axis, and the curved section 340. The curved section 340 is positioned below the planar section 338, between the planar section 338 and the second end 330 of the third duct 326 and curves inwards, toward the flywheel 502, as the curved section 340 extends from the planar section 338 to the second end 330. A depth of the third duct 326, defined along the x-axis, may taper along the curved section 340 and become narrower at the second end 330 than through the planar section 338. A larger portion of the third duct 326 may be formed from the planar section 338 than the curved section 340.

The I4 engine 400 may have a specific cylinder phasing, e.g., cycling of pistons between BDC and TDC and injection of air and fuel accordingly. For example, the first cylinder 404 and the fourth cylinder 410 may operate in-phase with one another but out-of-phase with the second cylinder 406 and third cylinder 408, which are, in turn, in-phase with one another. The phasing of the cylinders results in an offset timing of blow-by gas generation and delivery through the first, second, and third ducts 306, 318, 326, and into the central merging chamber 302 of the ducted plenum 300.

The phasing of the I4 engine 400 is illustrated in a cross-section 900, taken along the y-z plane of the I4 engine 400 shown in FIG. 9. A first piston 902 is arranged in the first cylinder 404, a second piston 904 arranged in the second cylinder 406, a third cylinder 906 arranged in the third cylinder 408, and a fourth piston 908 arranged in the fourth cylinder 410, the cylinders configured to slide up and down, along the cylinder axis 402 within the respective cylinders. As depicted in FIG. 9, the first and fourth cylinders 404, 410 are in-phase with the first piston 902 and the second piston 904 at TDC. The second and third cylinders 406, 408, are both out-of-phase with the first and fourth cylinders 402, 410, with the second piston 904 and third piston 906 at BDC.

Blow-by gases flow through each cylinder is shown by sets of arrows. The ducted plenum, e.g., the ducted plenum 302 of FIGS. 3-5, is not shown in FIG. 9. Instead, openings at second ends of ducts of the ducted plenum that couple to ports in the wall of the crankcase 403 are indicated by ovals. For example, in the first cylinder 404, blow-by gases flow, according to arrows 910, from below the first piston 902, relative to the y-axis, down through the first cylinder 404 into a first crankcase chamber 912. The opening 305 at the second end of the first duct, e.g., second end 316 of the first duct 306 of FIGS. 3 and 4, of the ducted plenum is positioned proximate to an upper region of the first crankcase chamber 912. Gases flowing down through the first cylinder 404 and into the upper regions of the first crankcase chamber 912 may flow into the opening 305 of the first duct of the ducted plenum.

Similarly, blow-by gases in the fourth cylinder 410 may flow from below the fourth piston 908, as indicated by arrows 914, down into an upper region of a second crankcase chamber 916. The opening 319 at the second end of the second duct, with reference to the second end 324 of the second duct 318 of FIGS. 3 and 4, of the ducted plenum is positioned proximate to the upper region of the second crankcase chamber 916. Gases flowing down through the fourth cylinder 410 and into the upper region of the second crankcase chamber 916 may flow into the opening 305 of the first duct of the ducted plenum.

In the second and third cylinder 406 and 408, blow-by gases in the cylinders flow down from below the second and third pistons 904 and 906, indicated by arrows 918 and 920, into a third crankcase chamber 922 and a fourth crankcase chamber 924, respectively. The gases travel down through the third and fourth crankcase chambers 922 and 924, reaching a lower regions of the crankcase chambers. The opening 329 at the second end of the third duct, e.g., second end 330 of the third duct 326 of FIGS. 3 and 4, may be wider, along the z-axis, than the opening 305 of the first duct and the opening 319 of the second duct. The greater width of the opening 329 of the third duct allows the opening 329 to directly couple to both the third crankcase chamber 922 and the fourth crankcase chamber 924, proximate to the lower regions of the crankcase chambers. Blow-by gases generated in both the second and third cylinders 406 and 408 may be channeled into the opening 329 of the third duct at a lower height, with respect to the y-axis, than the opening 305 of the first duct or the opening 319 of the second duct.

During engine operations, gases vented from the first cylinder 404 and fourth cylinder 410 may collect in the central merging chamber 302 of the ducted plenum 302 of FIGS. 3-5, during downward piston strokes in the first and fourth cylinders 404, 410. The entry of the crankcase gases into the central merging chamber 302 may generate pressure in the central merging chamber 302. The pressure in the central merging chamber 302 may lead to PCV flow from the central merging chamber 302 into the upper chamber 304, travelling through a flow path that includes an oil separator 412 and a PCV valve 414, the PCV valve downstream of the oil separator 412 in the flow path. As the pistons in the first and fourth cylinders 404, 410 return to TDC, downward piston strokes of the second and third cylinders 406, 408 may occur, inducing flow of crankcase gases from the cylinder bays of the second and third cylinders 406, 408 into the central merging chamber 302 through the third duct 326.

If the pressure generated in the central merging chamber 302 due to influx of gases from the third duct 326 differs from the pressure generated by gas flow from the first and second ducts 306, 318, flow of combined gases from the central merging chamber 302 to the oil separator 412 may be turbulent, reducing an efficiency of the oil separator 412 from the gases. By regulating flow from the ducts of the ducted plenum 300, a pressure profile of the central merging chamber 302 may be maintained relatively uniform during engine operations, allowing the gases to settle and become more quiescent.

The gas flows channeled through each of the ducts of the ducted plenum 300 may be controlled based on a geometry of the ducted plenum 300 and dimensions of each of the ducts. As one example, an alignment of the ducts along the height, defined along the y-axis, of the engine may be varied to adjust gas flow velocities through the ducts. For example, the second duct 318 may be aligned with a bottom end of the fourth combustion chamber 410, where gas flow velocity in the crankcase is highest. The first duct 306 may extend from the central merging chamber 302 at a lower height, relative to the y-axis, than the second duct 318. In other words, a vertical position of the first duct 306 may be offset from a vertical position of the second duct 318. The first duct 306 is aligned below a bottom end of the first combustion chamber 404 and, as a result, gas flow from the first combustion chamber 404 into the first duct 306 may be slower than in the second duct 318. However, the first duct 306 may be longer than the second duct 318, along the z-axis, which may offset the difference in height between the ducts, and thereby equalizing the flow velocities of gases travelling through the ducts.

The ducted plenum 300 may be positioned along the crankcase so that the central merging chamber 302 and the upper chamber 304 are substantially centered relative to a length, defined along the z-axis, and along the central axis of the crankshaft, of the I4 engine 400. As such, if the opening at the second end 330 of the third duct 326 were at a similar height as the first duct 306 or second duct 318, the third duct would be very short due to a proximity of the second end 330 to the second and third cylinders 406, 408, and the alignment of the third duct 326 centered between the second and third cylinders. The flow of gas through the third duct 326 would be much faster than the flow velocities through the first and second ducts 306, 318, generating higher pressure in the central merging chamber 302 than pressure generated by the combined flows form the first and second ducts, as well as high degree of turbulence in the central merging chamber 302.

By configuring the third duct 326 to couple, at the second end 330, to the second and third cylinders 406, 408, at a bottom portion of the crankcase above the oil sump 416, a velocity of vented gases from the cylinders may be slower than the velocities of gases flowing from the first cylinder 404 and fourth cylinder 410 through the first duct 306 and second duct 318, respectively. The velocity of vented gases may be sufficiently reduced by lowering the point of coupling between the third duct 326 and the second and third cylinders 406, 408, through the crankcase, so that the velocity of gases delivered at the central merging chamber 302 by the third duct 326 is similar to the velocities of gases delivered by the first and second ducts 306, 318. By matching the velocities of gas flows from all three ducts, a pressure profile of the central merging chamber 302 may remain constant and turbulence in gas flow may be suppressed.

As another example, flow velocities through the ducts may be alternatively or additionally controlled by adjusting diameters and lengths of the ducts. While increasing or decreasing the length of the third duct 326 may adjust the height, with respect to the cylinder axis 402, where gases are vented from the crankcase into the third duct 326, with the height affecting the flow velocity, varying a diameter of the third duct 326 may also affect PCV flow entering the central merging chamber 320. Decreasing the diameter of the third duct 326, either along the x-axis or the z-axis, may increase velocity of gas flow while increasing the diameter may decrease flow velocity.

Similar adjustments to dimensions of the first duct 306 and second duct 318 may allow the velocities of gases flowing into the central merging chamber 302 to produce incoming flow rates and pressures comparable to the gas influx and pressure generated by gas ventilation through the third duct 326. For example, if the central merging chamber 302 and upper chamber 304 are biased towards, e.g., closer to, the first cylinder 404 due to available space in the cylinder bay, the first duct 306 may have a shorter length than the second duct 318, leading to higher flow velocity in the first duct 306. In order to balance the flows so that the velocities through the ducts are similar, the diameter of the first duct 306 may be widened and/or the diameter of the second duct 318 may be decreased. Alternatively the alignment of the first duct 306 may be lowered along the y-axis so that the first duct 306 couples to the crankcase at a lower point than shown in FIG. 4.

It will be appreciated that while the ducted plenum 300 shown in FIGS. 3-5 may be adapted to couple specifically to an I4 engine, a ducted plenum of a PCV system may be configured to couple to a variety of engine types. For example, the ducted plenum may be modified to be casted into a crankcase for a V6 engine, a V8 engine, or an I3 engine with three in-line cylinders. Examples of a ducted plenum for an I3 engine are shown in FIGS. 6 and 7 including crankcases but without engine blocks.

In a first schematic diagram 600 of an I3 engine 602, a ducted plenum 604 may be positioned so that an upper chamber 606 and a central merging chamber 608 of the ducted plenum 604 are aligned directly in front of a central, first cylinder 610. A portion of the central merging chamber 608, arranged below and coupled to the upper chamber 606, may extend above an upper surface 612 of a crankcase 614. A crankshaft 615 may extend from a side of the crankcase 614, aligned with a central axis 605 that is parallel with the z-axis and perpendicular to a cylinder axis 622 of the I3 engine 602. The upper chamber 606 of the ducted plenum 604 may be entirely above the crankcase 614.

The central merging chamber 608 of the ducted plenum 604 may be directly and fluidly coupled to a first duct 616, a second duct 618, and a third duct 620, arranged around the central merging chamber 608 so that the ducted plenum 604 is mirror-symmetric about the cylinder axis 622 of the I3 engine 602 and of the ducted plenum 604. The first duct 616 and second duct 618 may be of similar lengths and diameters, and extend away from the central merging chamber 608 along the z-axis so that the first duct 616 extends along the upper surface 612 of the crankcase 614 across a portion of a width, measured along the z-axis, of a second cylinder 624. Similarly, the second duct 618 may extend along the upper surface 612 of the crankcase 614 across a portion of a width of a third cylinder 626. Openings in the first and second ducts 616, 618 at ends of the ducts distal from the central merging chamber 608 may couple to ports in the upper surface 612 of the crankcase 614 so that blow-by gases generated in the first and third cylinders 624, 626 may be vented out of the crankcase 614 through the first and second ducts 616 and 618, respectively.

The third duct 620 may be aligned perpendicular to the first and second ducts 616, 618 and parallel with the cylinder axis 622. The third duct 620 may extend downwards, away from the central merging chamber 608, along a portion of a height, defined along the y-axis, of the crankcase 614. An opening at a bottom end of the third duct 620, distal from the central merging chamber 608, may couple to a port in the crankcase to vent blow-by gases generated in the first cylinder 610.

In a second schematic diagram 700 shown in FIG. 7, the I3 engine 602 is coupled to another embodiment of a ducted plenum 702. The ducted plenum 702 is not mirror-symmetric about the cylinder axis 622. Instead, an upper chamber 704 and a central merging chamber 706 may be aligned with the second cylinder 624. A first duct 708 may extend downwards from the central merging chamber, along the y-axis, along at least a portion of the height of the crankcase 614 and include an opening at a bottom end of the first duct 708, distal to the central merging chamber 706, that couples to a port in the crankcase 614 so that blow-by gases from the second cylinder 624 may vent into the first duct 708.

A second duct 710 may be aligned perpendicular to the first duct 708 and the cylinder axis 622, extending from the central merging chamber 706 across a portion of a width of the crankcase 614, along the z-axis. A distal end 712 of the second duct 710, relative to the central merging chamber 706, may be positioned in front of the third cylinder 626 so that an opening in the distal end 712 of the second duct 710 may couple to the third cylinder 626 through the crankcase 614 and allow blow-by gases from the third cylinder 626 to be channeled to the central merging chamber 706 through the second duct 710.

A third duct 714 may extend downwards, along the y-axis, from the second duct 710, rather than from the central merging chamber 706. The third duct 714 may be parallel with the first duct 708, positioned below the first cylinder 610 along the cylinder axis 622 and may couple to the second duct 710 at a mid-point of the second duct 710 between an end of the second duct that is connected to the central merging chamber 706 and a distal end 712 of the second duct 710. A distal end 716, relative to the second duct 710, of the third duct 714 may include an opening that couples to a port in the crankcase 614 that allows the third duct 714 to vent blow-by gases from the first cylinder 610, the gases in the third duct 714 merging with gases from the third cylinder 626 in the second duct 710 before flowing into the central merging chamber 706.

A geometry and alignment of a ducted plenum may vary depending on available space around an engine. Either of the embodiments of the ducted plenum shown in FIGS. 6 and 7, as well as other variations in shape and dimensions, may be adapted to an I3 engine without affecting a capacity of the ducted plenum to vent blow-by gases from cylinders of the engine and an effectiveness of oil extraction from the gases by an oil separation downstream of the ducted plenum. A geometry of the ducted plenum, e.g., duct length, diameter, and height, may be adjusted according to a distance that the vented gas travels from the cylinder in which the gases are first generated to the central merging chamber. Dimensions of the ducts may depend on a positioning of the central merging chamber which may be aligned as shown in FIGS. 6 and 7, or centered over a width of the third cylinder 626 or arranged so that a width of the central merging chamber overlaps partially across widths of two adjacent cylinders. The geometry may also compensate for any pressure differentials that may be created in the ducted plenum due to a phasing of the cylinders. The geometry of the ducted plenum may dampen turbulence in gas flow through the central merging chamber, thus allowing for efficient removal of entrained oil.

Figure 8:
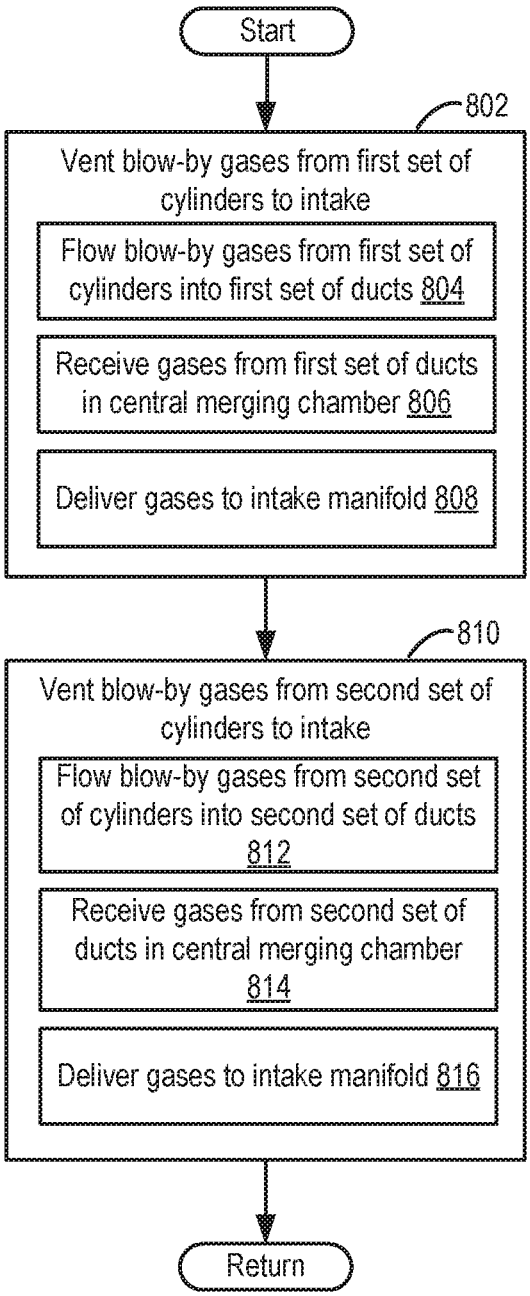
FIG. 8 shows an example of a routine for a PCV system with a ducted plenum channeling blow-by gases through components of the PCV system.
Figure 9:
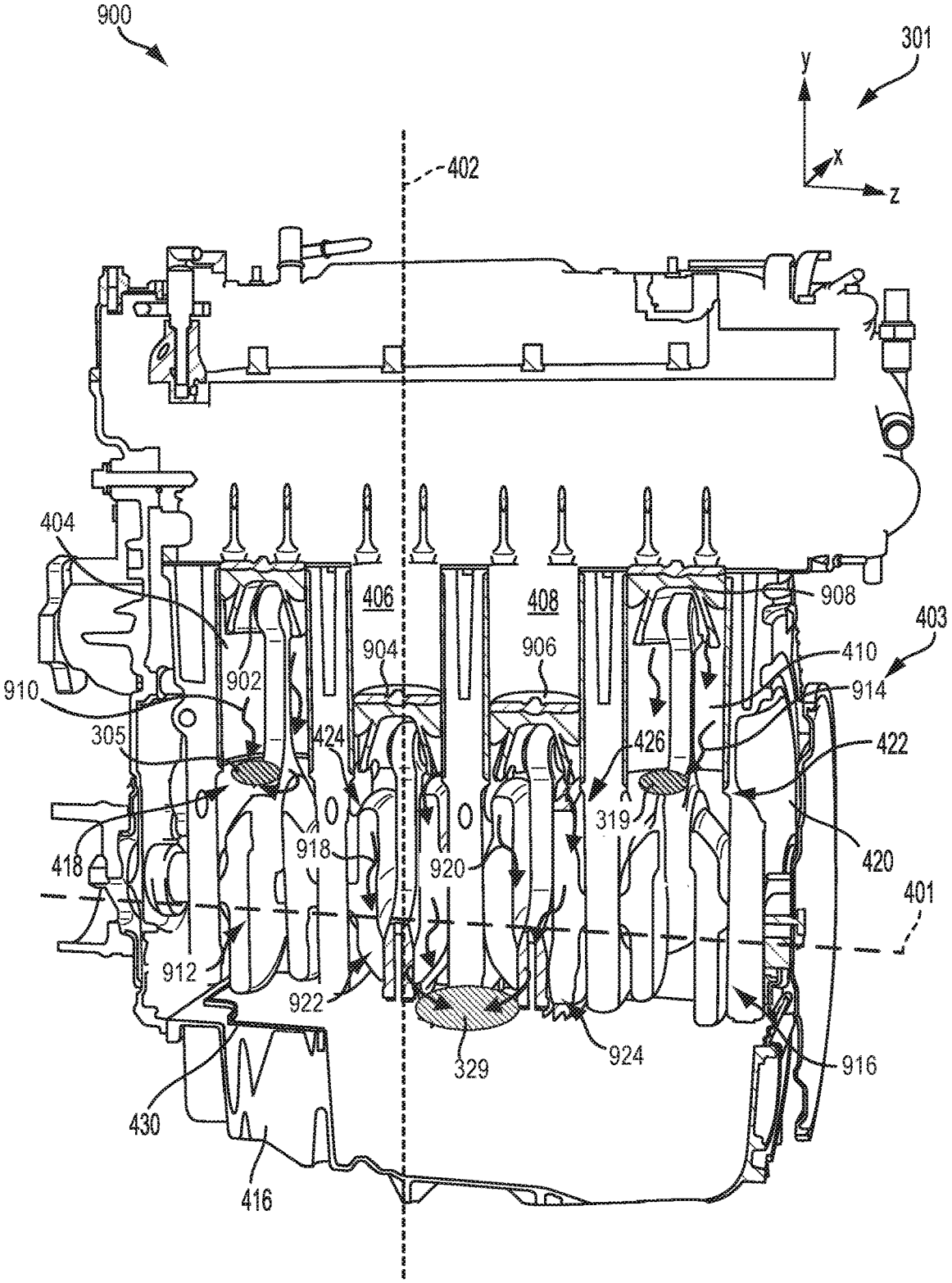
FIG. 9 shows a cross-section of the engine of FIG. 4, illustrating flow paths of blow-by gases from the cylinders to the ducted plenum.

An example of a routine 800 is shown in FIG. 8 for a PCV system including a ducted plenum, such as the ducted plenum 300 of FIGS. 3-5, 602 of FIG. 6, and 702 of FIG. 7, during engine operations where piston motion is driven by a crankshaft. The ducted plenum may be coupled to a crankcase and may include a central merging chamber that is fluidly coupled to each of an upper chamber, the upper chamber housing an oil separator, a PCV valve, and a PCV outlet, and a plurality of ducts. The plurality of ducts may comprise a first set of ducts that are fluidly coupled to a first set of cylinders that are in-phase with one another, and a second set of ducts that are fluidly coupled to a second set of cylinders that are in-phase with one another and out of phase with the first set of cylinders. Each of the first and second set of cylinders may include one or more cylinders.

At 802, the routine includes venting blow-by gases from the first set of cylinders to an intake system of the engine. As pistons of the first set of cylinders cycle from TDC to BDC upon ignition at the first set of cylinders, combustion gases may leak past the pistons into the crankcase. Venting the blow-by gases includes flowing the gases, at 804, through cylinder bays surrounding the cylinders, down into an interior of the crankcase and into the first set of ducts. The routine also includes receiving the blow-by gases from the first set of ducts in the central merging chamber at 806. The first set of ducts may have dimensions and alignments, relative to the crankcase and first set of cylinders, that allow the velocities of the incoming PCV flows to generate a targeted pressure within the central merging chamber. At 808 of the routine, the PCV system delivers blow-by gases from the first set of cylinders from the central merging chamber, through the oil separator within the upper chamber, where entrained oil mist is removed from the gases and through and opening of the PCV valve. The PCV valve opening may be adjusted to allow flow of blow-by gas therethrough according to a pressure of the central merging chamber or based on a desired flow of blow-by gases to the intake manifold. For example, the pressure in the central merging chamber may exert a force on PCV valve if the valve is configured to be passively actuated, and an amount of opening of the valve may scale with the force exerted. Alternatively, if the PCV valve is controlled by the controller, the controller may vary the opening of the PCV valve based on a desired AFR at the cylinders or based on a crankcase pressure detected by a pressure sensor, such as crankcase pressure sensor 276 of FIG. 2. Gases may flow through the PCV valve, out of the PCV outlet and into the intake manifold.

At 810, the routine includes venting blow-by gases from the second set of cylinders to the intake system of the engine. Venting of blow-by gases from the second set of cylinders may initiate concurrently with reception of gases from the first set of ducts at the central merging chamber at 806 or with delivery of gases from the first set of ducts to the intake manifold at 808, depending on a phasing overlap between the first set of cylinders and second set of cylinders. As the pistons in the first set of cylinders cycle from BDC to TDC, the second set of cylinders may undergo power strokes at the pistons, from TDC to BDC. Combustion gases in the second set of cylinders may leak past the pistons into the surrounding cylinder bays and down in to the crankcase. Blow-by gases accumulating in the crankcase from the second set of cylinders may flow through the second set of ducts at 812.

At 814 of the routine, the central merging chamber of the ducted plenum receives the blow-by gases from the second set of ducts. The second set of ducts may be configured so that velocities of PCV flow through the second set of ducts are similar to the velocities of PCV flow through the first set of ducts. As a result, a similar pressure in the central merging chamber is generated due to gases from the second set of ducts as to gases from the first set of ducts and turbulence in the central merging chamber is dampened. The PCV valve opening may be adjusted according to a pressure of the central merging chamber or based on a desired flow of blow-by gases to the intake manifold, as described above. The blow-by gases from the second set of cylinders is flowed through the oil separator to remove oil, through the PCV valve and PCV outlet and delivered to the intake manifold at 816. Following 816, the routine 800 returns to 802.

In this way, a ducted plenum of a PCV system may control velocities of blow-by gas flows delivered to a central merging chamber of the ducted plenum. The central merging chamber may be fluidly coupled to two or more ducts and the ducts may be fluidly coupled to at least one cylinder bay surrounding combustion chambers of the engine through a crankcase positioned below the combustion chambers. Blow-by gases accumulating in the crankcase may be vented out of the crankcase. Flow velocities through each of the ducts may be controlled by adjusting geometries of the ducts, including diameters and lengths of the ducts as well as a distance from bottoms of the combustion chambers that the ducts couple to the crankcase with respect to a height of the crankcase. By controlling velocities of PCV flow through the ducts, a pressure signature of the central merging chamber may be maintained more uniform and a quiescent region is created in the central merging chamber, allowing gases to settle before flowing through an oil separator. The blow-by gases may be delivered to an intake system of an engine after passing through the oil separator and the PCV valve, with the oil separator and the PCV valve arranged in an upper chamber above and fluidly coupled to the central merging chamber. As a result, removal of entrained oil from the gases is improved and a likelihood of entrainment of oil mist into the combustion chambers is decreased.

The technical effect of configuring the PCV system with the ducted plenum is that an efficiency of the oil separator is increased and engine performance is improved.

In one embodiment, a ducted plenum for a PCV system includes a central chamber, an upper chamber including an oil separator and a PCV valve, and coupled to and extending upward from the central chamber, in a vertical direction, a first duct coupled to and extending outward from the central chamber in a direction perpendicular to the vertical direction, and a second duct coupled to and extending downward and away from the central chamber. In a first example of the ducted plenum, a third duct extends outward from the central chamber in a direction perpendicular to the vertical direction and opposite of the first duct. A second example of the ducted plenum optionally includes the first example and further includes wherein the third duct couples to the central chamber at a vertical position along the central chamber that is offset from a vertical position where the first duct couples to the central chamber. A third example of the ducted plenum optionally includes one or more of the first and second examples, and further includes wherein each of the first and third ducts include sections that curve outward in a direction perpendicular to the vertical direction along lengths of the first and third ducts. A fourth example of the ducted plenum optionally includes one or more of the first through third examples, and further includes, wherein the second duct is widest, the width defined perpendicular to the vertical direction, at a first end that couples to the central chamber and tapers along a length of the second duct, the length parallel with the vertical direction, to become narrower at a second end, the second end opposite of the first end, of the second duct. A fifth example of the ducted plenum optionally includes one or more of the first through fourth examples, and further includes, wherein the second duct curves along the length of the second duct in a direction perpendicular to the vertical direction.

As another embodiment, a system includes a crankshaft disposed in a crankcase, and a ducted plenum, the ducted plenum comprising, an upper chamber including an oil separator, PCV valve, and PCV gas outlet, a central chamber coupled to a bottom of the upper chamber relative to a vertical direction that is perpendicular to a central axis of the crankshaft, a first cylinder duct coupled to the central chamber and a first bay of a first cylinder of the engine, and a crankcase duct coupled between the central chamber and a bottom of the crankcase. In a first example of the system, an oil sump coupled to the bottom of the crankcase. A second example of the system optionally includes the first example, and further includes wherein the first cylinder duct extends outward from the central chamber in a direction parallel with the central axis and fluidly couples to the first bay through a top of the crankcase. A third example of the system optionally includes one or more of the first and second examples, and further includes, a second cylinder duct coupled to the central chamber and a second bay of a second cylinder of the engine, the second cylinder duct extending outward from the central chamber, in a direction opposite of the first cylinder duct and parallel with the central axis. A fourth example of the system optionally includes one or more of the first through third examples, and further includes, wherein the second cylinder duct fluidly couples to the second bay of the second cylinder through an upper portion of the crankcase. A fifth example of the system optionally includes one or more of the first through fourth examples, and further includes, wherein a third cylinder duct couples directly to the first cylinder duct, at a middle portion of the first cylinder duct between where the first cylinder duct fluidly couples to the first bay and where the first cylinder duct couples to the central chamber. A sixth example of the system optionally includes one or more of the first through fifth examples, and further includes, wherein the third cylinder duct extends downward, in the vertical direction from the first cylinder duct, and fluidly couples to a third bay of a third cylinder of the engine. A seventh example the system optionally includes one or more of the first through sixth examples, and further includes, wherein the crankcase duct fluidly couples to one or more cylinder bays of the engine through the bottom of the crankcase. An eighth example the system optionally includes one or more of the first through sixth examples, and further includes, wherein the oil separator is positioned upstream of the PCV valve and the PCV valve is positioned upstream of the PCV gas outlet in the upper chamber.

As another embodiment, a method includes flowing blow-by gases generated by a first set of cylinders from a bottom of a crankcase, at a location below a crankshaft, to a central chamber of a ducted plenum of a PCV system via a vertically-oriented first duct, flowing blow-by gases generated by a second cylinder from a second bay of the second cylinder to the central chamber via a horizontally-oriented second duct, flowing blow-by gases from the central chamber to an upper chamber of the ducted plenum, the central chamber coupled to a bottom of the upper chamber, and through an oil separator arranged in the upper chamber, adjusting a flow of gases from the upper chamber to an engine intake system via adjusting a PCV valve arranged in the upper chamber, downstream of the oil separator. In a first example of the method, blow-by gases generated by a third cylinder from a third bay of the third cylinder are flowed via a horizontally-oriented third duct, the third duct coupled to the central chamber at a location opposite of where the first duct couples to the central chamber. A second example of the method optionally includes the first example, and further includes, flowing blow-by gases generated by a fourth cylinder from a fourth bay of the fourth cylinder via a vertically-oriented fourth duct, the fourth duct extending from a mid-point of the second duct, between where the second duct couples to the central chamber and where the second duct couples to the second bay, to the fourth bay. A third example of the method optionally includes one or more of the first and second examples, and further includes, maintaining a uniform pressure signature of the central chamber as gases are flowed into the central chamber. A fourth example of the method optionally includes one or more of the first through third examples, and further includes, wherein flowing blow-by gases from the first set of cylinders and the second cylinder includes flowing gases at a first velocity through the vertically-oriented duct than a second velocity through the horizontally-oriented duct, the first velocity and the second velocity each dependent on a geometry and positioning of the vertically-oriented duct and the horizontally-oriented duct relative to crankcase, the first set of cylinders, and the second cylinder.

In another representation, a system for an engine includes a plurality of cylinders, a crankcase including a crankshaft, the crankcase fluidly coupled to cylinder bays, each cylinder bay fluidly coupled to a bottom of one of the plurality of cylinders, the crankcase positioned vertically below the plurality of cylinders, a positive crankcase ventilation (PCV) system including a ducted plenum, the ducted plenum comprising, an upper chamber including a PCV valve and oil separator, the PCV valve arranged downstream of the oil separator, a central chamber coupled to a bottom of the upper chamber, relative to a vertical direction that is perpendicular to a central axis of the crankshaft, a first duct directly coupled to the central chamber and a first cylinder bay of a first cylinder of the plurality of cylinders, the first duct extending horizontally, in a direction parallel to the central axis, between the central chamber and first cylinder bay, and a second duct directly coupled to the central chamber and a bottom of the crankcase, at a location vertically below the crankshaft, the second duct extending vertically, in the vertical direction, between the bottom of the crankcase and the central chamber. A first example of the system includes a third duct directly coupled to the central chamber and a second cylinder bay and extends horizontally from the central chamber, opposite of the first duct, to the second cylinder bay. A second example of the system optionally includes the first example and further includes wherein a third duct is directly coupled to the central chamber and a second cylinder bay and extends horizontally from the central chamber, opposite of the first duct, to the second cylinder bay. A third example of the system optionally includes one or more of the first and second examples, and further includes wherein a vertical position of the first duct, relative to a direction perpendicular to the central axis, is offset from a vertical position of the third duct. A fourth example of the system optionally includes one or more of the first through third examples, and further includes, wherein a fourth duct couples directly to the first cylinder duct, at a middle portion of the first cylinder duct between where the first cylinder duct couples to the first bay and where the first cylinder duct couples to the central chamber, and couples to a third cylinder bay. A fifth example of the system optionally includes one or more of the first through fourth examples, and further includes wherein the second duct fluidly couples to one or more cylinder bays through the bottom of the crankcase.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A ducted plenum for a positive crankcase ventilation (PCV) system, comprising;

a central chamber;

an upper chamber including an oil separator and a PCV valve, and coupled to and extending upward from the central chamber, in a vertical direction;

a first duct coupled to and extending outward from the central chamber in a direction perpendicular to the vertical direction; and a second duct coupled to and extending downward and away from the central chamber.

2. The ducted plenum of claim 1, wherein a third duct extends outward from the central chamber in a direction perpendicular to the vertical direction and opposite of the first duct.

3. The ducted plenum of claim 2, wherein the third duct couples to the central chamber at a vertical position along the central chamber that is offset from a vertical position where the first duct couples to the central chamber.

4. The ducted plenum of claim 3, wherein each of the first and third ducts include sections that curve outward in a direction perpendicular to the vertical direction along lengths of the first and third ducts.

5. The ducted plenum of claim 1, wherein the second duct is widest, the width defined perpendicular to the vertical direction, at a first end that couples to the central chamber and tapers along a length of the second duct, the length parallel with the vertical direction, to become narrower at a second end, the second end opposite of the first end, of the second duct.

6. The ducted plenum of claim 4, wherein the second duct curves along the length of the second duct in a direction perpendicular to the vertical direction.

7. A system for an engine, comprising;

a crankshaft disposed in a crankcase; and a ducted plenum, the ducted plenum comprising;

an upper chamber including an oil separator, PCV valve, and PCV gas outlet;

a central chamber coupled to a bottom of the upper chamber relative to a vertical direction that is perpendicular to a central axis of the crankshaft;

a first cylinder duct coupled to the central chamber and a first bay of a first cylinder of the engine; and a crankcase duct coupled between the central chamber and a bottom of the crankcase.

8. The system of claim 7, further comprising an oil sump coupled to the bottom of the crankcase.

9. The system of claim 7, wherein the first cylinder duct extends outward from the central chamber in a direction parallel with the central axis and fluidly couples to the first bay through a top of the crankcase.

10. The system of claim 9, further comprising a second cylinder duct coupled to the central chamber and a second bay of a second cylinder of the engine, the second cylinder duct extending outward from the central chamber, in a direction opposite of the first cylinder duct and parallel with the central axis.

11. The system of claim 10, wherein the second cylinder duct fluidly couples to the second bay of the second cylinder through an upper portion of the crankcase.

12. The system of claim 7, wherein a third cylinder duct couples directly to the first cylinder duct, at a middle portion of the first cylinder duct between where the first cylinder duct fluidly couples to the first bay and where the first cylinder duct couples to the central chamber.

13. The system of claim 12, wherein the third cylinder duct extends downward, in the vertical direction from the first cylinder duct, and fluidly couples to a third bay of a third cylinder of the engine.

14. The system of claim 7, wherein the crankcase duct fluidly couples to one or more cylinder bays of the engine through the bottom of the crankcase.

15. The system of claim 7, wherein the oil separator is positioned upstream of the PCV valve and the PCV valve is positioned upstream of the PCV gas outlet in the upper chamber.

16. A method comprising;

flowing blow-by gases generated by a first set of cylinders from a bottom of a crankcase, at a location below a crankshaft, to a central chamber of a ducted plenum of a PCV system via a vertically-oriented first duct;

flowing blow-by gases generated by a second cylinder from a second bay of the second cylinder to the central chamber via a horizontally-oriented second duct;

flowing blow-by gases from the central chamber to an upper chamber of the ducted plenum, the central chamber coupled to a bottom of the upper chamber, and through an oil separator arranged in the upper chamber;

adjusting a flow of gases from the upper chamber to an engine intake system via adjusting a PCV valve arranged in the upper chamber, downstream of the oil separator.

17. The method of claim 16, further comprising flowing blow-by gases generated by a third cylinder from a third bay of the third cylinder via a horizontally-oriented third duct, the third duct coupled to the central chamber at a location opposite of where the first duct couples to the central chamber.

18. The method of claim 16, further comprising flowing blow-by gases generated by a fourth cylinder from a fourth bay of the fourth cylinder via a vertically-oriented fourth duct, the fourth duct extending from a mid-point of the second duct, between where the second duct couples to the central chamber and where the second duct couples to the second bay, to the fourth bay.

19. The method of claim 16, further comprising maintaining a uniform pressure signature of the central chamber as gases are flowed into the central chamber.

20. The method of claim 16, wherein flowing blow-by gases from the first set of cylinders and the second cylinder includes flowing gases at a first velocity through the vertically-oriented duct than a second velocity through the horizontally-oriented duct, the first velocity and the second velocity each dependent on a geometry and positioning of the vertically-oriented duct and the horizontally-oriented duct relative to crankcase, the first set of cylinders, and the second cylinder.

* * * * *